US010024032B2

(12) United States Patent
Mizuochi et al.

(10) Patent No.: US 10,024,032 B2
(45) Date of Patent: Jul. 17, 2018

(54) WORK MACHINE

(71) Applicant: Hitachi Construction Machinery Co., Ltd., Taito-ku, Tokyo (JP)

(72) Inventors: Mariko Mizuochi, Tsuchiura (JP); Akinori Ishii, Ushiku (JP); Kazuyoshi Hanakawa, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 65 days.

(21) Appl. No.: 15/183,132

(22) Filed: Jun. 15, 2016

(65) Prior Publication Data

US 2016/0369480 A1 Dec. 22, 2016

(30) Foreign Application Priority Data

Jun. 17, 2015 (JP) ..... 2015-122306

(51) Int. Cl.

| | |
|---|---|
| ***F15B 11/16*** | (2006.01) |
| ***E02F 9/22*** | (2006.01) |
| ***E02F 3/32*** | (2006.01) |
| ***E02F 9/26*** | (2006.01) |
| ***F15B 13/06*** | (2006.01) |
| *E02F 3/96* | (2006.01) |

(52) U.S. Cl.

CPC ..... *E02F 9/2228* (2013.01); *E02F 3/32* (2013.01); *E02F 9/2203* (2013.01); *E02F 9/2207* (2013.01); *E02F 9/2253* (2013.01); *E02F 9/2267* (2013.01); *E02F 9/2271* (2013.01); *E02F 9/2285* (2013.01); *E02F 9/268* (2013.01); *F15B 11/16* (2013.01); *F15B 13/06* (2013.01); *E02F 3/964* (2013.01); *F15B 2211/575* (2013.01)

(58) Field of Classification Search

CPC combination set(s) only.
See application file for complete search history.

(56) References Cited

U.S. PATENT DOCUMENTS

| | | | | |
|---|---|---|---|---|
| 5,822,891 | A * | 10/1998 | Fujishima | E02F 9/2033 37/348 |
| 5,970,709 | A * | 10/1999 | Tohji | E02F 9/2242 60/421 |
| 6,415,604 | B1 * | 7/2002 | Motomura | E02F 9/2033 60/399 |

(Continued)

FOREIGN PATENT DOCUMENTS

| | | |
|---|---|---|
| JP | 2871105 B2 | 3/1999 |
| WO | WO 2012/169531 A1 | 12/2012 |

*Primary Examiner* — Adam D Tissot
*Assistant Examiner* — Edward J Pipala
(74) *Attorney, Agent, or Firm* — Crowell & Moring LLP

(57) ABSTRACT

The work machine includes a stabilization control calculation unit that calculates and outputs a gradual stoppage command for making a drive actuator stop gradually and an operation speed limitation command for limiting an upper limit operation speed according to the status of stability of the work machine, a stoppage characteristic modification unit that corrects pilot pressure so as to make the drive actuator stop gradually when a stoppage operation is performed on a control lever, and an operation speed limitation unit that corrects the pilot pressure so as to limit the operation speed of the drive actuator.

3 Claims, 18 Drawing Sheets

(56) References Cited

U.S. PATENT DOCUMENTS

| | | | | |
|---|---|---|---|---|
| 2009/0094972 | A1* | 4/2009 | Kauss | E02F 9/2203 60/393 |
| 2012/0310492 | A1* | 12/2012 | Karasawa | E02F 9/2253 701/50 |
| 2014/0121840 | A1 | 5/2014 | Mizuochi et al. | |
| 2015/0292178 | A1* | 10/2015 | Nagato | E02F 9/2285 701/50 |
| 2015/0354172 | A1* | 12/2015 | Hijikata | F15B 11/024 60/414 |
| 2016/0025215 | A1* | 1/2016 | Thoms | F16H 61/4017 60/327 |
| 2016/0040398 | A1* | 2/2016 | Kitajima | E02F 3/435 701/50 |
| 2016/0215475 | A1* | 7/2016 | Meguriya | E02F 3/32 |
| 2016/0251836 | A1* | 9/2016 | Baba | E02F 3/435 701/50 |
| 2016/0273194 | A1* | 9/2016 | Ikegami | E02F 3/435 |

* cited by examiner

WORK MACHINE

BACKGROUND OF THE INVENTION

1. Field of the Invention

The present invention relates to a work machine used for structure demolition works, waste disposal, scrap handling, road works, construction works, civil engineering works, and so forth.

2. Description of the Related Art

Work machines including a track structure for traveling by use of a power system, a swing structure mounted on the top of the track structure to be swingable, a front work implement of the multijoint type attached to the swing structure to be pivotable in the vertical direction, and actuators each of which drives a corresponding front member constituting the front work implement are well known as work machines used for structure demolition works, waste disposal, scrap handling, road works, construction works, civil engineering works, and so forth. As an example of such a work machine, there is a work machine configured based on a hydraulic excavator and including a boom whose one end is pivotably connected to the swing structure, an arm whose one end is pivotably connected to the tip end of the boom, and an attachment such as a grapple, bucket, breaker or crusher attached to the tip end of the arm so that an intended work can be performed.

This type of work machine performs the work while changing its attitude in various ways with the boom, the arm and the attachment of the front work implement projecting outward from the swing structure. Thus, the work machine can lose balance when the operator performs a forceful operation such as putting an excessive workload on a part of the work machine or conducting a quick motion in a state with an excessive load and the front work implement expanded. Therefore, a variety of overturn prevention technologies have been proposed for this type of work machines.

For example, in a technology disclosed in Japanese Patent No. 2871105, angle sensors are provided on the boom and the arm of the work machine and a detection signal from each angle sensor is inputted to a control unit. The control unit calculates the center of gravity of the entire work machine and support force of each stable supporting point at the grounding surface of the track structure based on the detection signals. Support force values at the stable supporting points based on the result of the calculation are displayed on a display device. A warning is issued when the support force at a rear stable supporting point has decreased below a limit value for securing the work safety.

On the other hand, a work machine for performing the aforementioned demolition work carries out the work by driving the track structure, the swing structure and the front work implement that are massive. Thus, if the operator performs an operation for suddenly stopping the driving of the currently moving track structure, swing structure or front work implement for some reason, strong inertial force acts on the work machine and significantly affects the stability of the work machine. Especially when the operator hastily performs an operation for stopping the driving of the currently moving track structure, swing structure or front work implement in response to a warning of a possibility of the overturn from a warning device installed in the work machine, strong inertial force can be added in an overturn direction and that can adversely increase the possibility of the overturn.

To deal with this kind of problem, WO 2012/169531 discloses a control technology, in which variations in the stability until the work machine reaches the complete stoppage in a case where a control lever has been instantaneously returned from an operation state to a stoppage command state are predicted by using a sudden stoppage model and positional information on movable parts of the track structure and the main body including the front work implement, and operation limitation on drive actuators is performed so that no instability occurs at any time till the stoppage.

SUMMARY OF THE INVENTION

By applying the technology described in WO 2012/169531 to a work machine, the overturn of the work machine can be prevented and the work can be continued in a stable condition even when a motion is suddenly stopped due to the operator's forceful or erroneous operation. The technology described in WO 2012/169531 is a technology of limiting the operation of a drive actuator of a work machine based on the result of a control calculation.

In general, the driving of a drive actuator of a work machine is controlled by a hydraulic pilot type drive hydraulic circuit including a pilot type flow control valve for controlling the supply of the hydraulic fluid to the drive actuator and a proportional pressure reducing valve for outputting pilot hydraulic fluid to the flow control valve according to the operator's operation on a control lever.

To perform the operation limitation on a drive actuator by applying the technology described in WO 2012/169531 to such a work machine, control means for changing the supply of the hydraulic fluid to the actuator according to the result of the control calculation has to be installed in the drive hydraulic circuit. However, the conventional technology has disclosed no configuration for implementing the operation limitation in a work machine including a hydraulic pilot type drive hydraulic circuit. Further, if the configuration of the drive hydraulic circuit is greatly modified for the installation of the control means in the drive hydraulic circuit, there is a danger that the responsiveness or the like changes and the conventional operability is impaired.

The object of the present invention, which has been made to resolve the above-described problems, is to implement the operation limitation necessary for keeping a work machine stable with a configuration capable of maintaining the conventional operability and to provide a work machine of excellent operability and stability.

To achieve the above object, an aspect of the present invention provides a work machine including: a work machine main body; a front work implement attached to the work machine main body to be freely pivotable in a vertical direction with respect to the work machine main body and including a plurality of movable parts; a drive actuator that drives a corresponding movable part of the front work implement; a calculation device that performs control calculation for controlling driving of the drive actuator; and an actuator drive hydraulic circuit including a flow control valve that controls supply of hydraulic fluid to the drive actuator and a proportional pressure reducing valve that outputs pilot hydraulic fluid to be supplied to the flow control valve according to an operation on a control lever. The calculation device includes: a speed estimation unit that estimates speed of the work machine; a sudden stoppage behavior prediction unit that predicts behavior of the work machine on the assumption that the work machine stops suddenly based on the speed estimated by the speed estimation unit and an attitude of the work machine; a stability judgment unit that judges stability of the work machine based on the behavior predicted by the sudden stoppage behavior prediction unit; and an operation limitation determination unit that calculates and outputs a gradual stoppage command for limiting deceleration of the drive actuator and making the drive actuator stop gradually and an operation speed limitation command for limiting upper limit operation speed of the drive actuator based on result of the judgment by the stability judgment unit. The actuator drive hydraulic circuit includes a pilot pressure correction unit that corrects pilot pressure outputted from the proportional pressure reducing valve according to the gradual stoppage command and the operation speed limitation command from the operation limitation determination unit. The pilot pressure correction unit includes a stoppage characteristic modification unit that corrects the pilot pressure so as to make the drive actuator stop gradually when a stoppage operation is performed on the control lever and an operation speed limitation unit that corrects the pilot pressure so as to limit the operation speed of the drive actuator. The stoppage characteristic modification unit and the operation speed limitation unit are driven respectively by the gradual stoppage command and the operation speed limitation command from the operation limitation determination unit and correct the pilot pressure outputted from the proportional pressure reducing valve when the gradual stoppage command and the operation speed limitation command are inputted from the operation limitation determination unit, while supplying the pilot pressure outputted from the proportional pressure reducing valve to the flow control valve without making the correction when the gradual stoppage command and the operation speed limitation command are not inputted from the operation limitation determination unit.

According to the present invention, operation limitation depending on the status of stability of the work machine is performed with a configuration taking advantage of the conventional actuator drive circuit. Consequently, the operation limitation can be performed without impairing the operability, and the work machine can be kept stable.

DESCRIPTION OF THE PREFERRED EMBODIMENTS

Embodiments of the work machine according to the present invention will be described below with reference to figures.

First Embodiment

A first embodiment of the work machine according to the present invention will be described below with reference to FIGS. 1-9B.

Object Device

Figure 1:
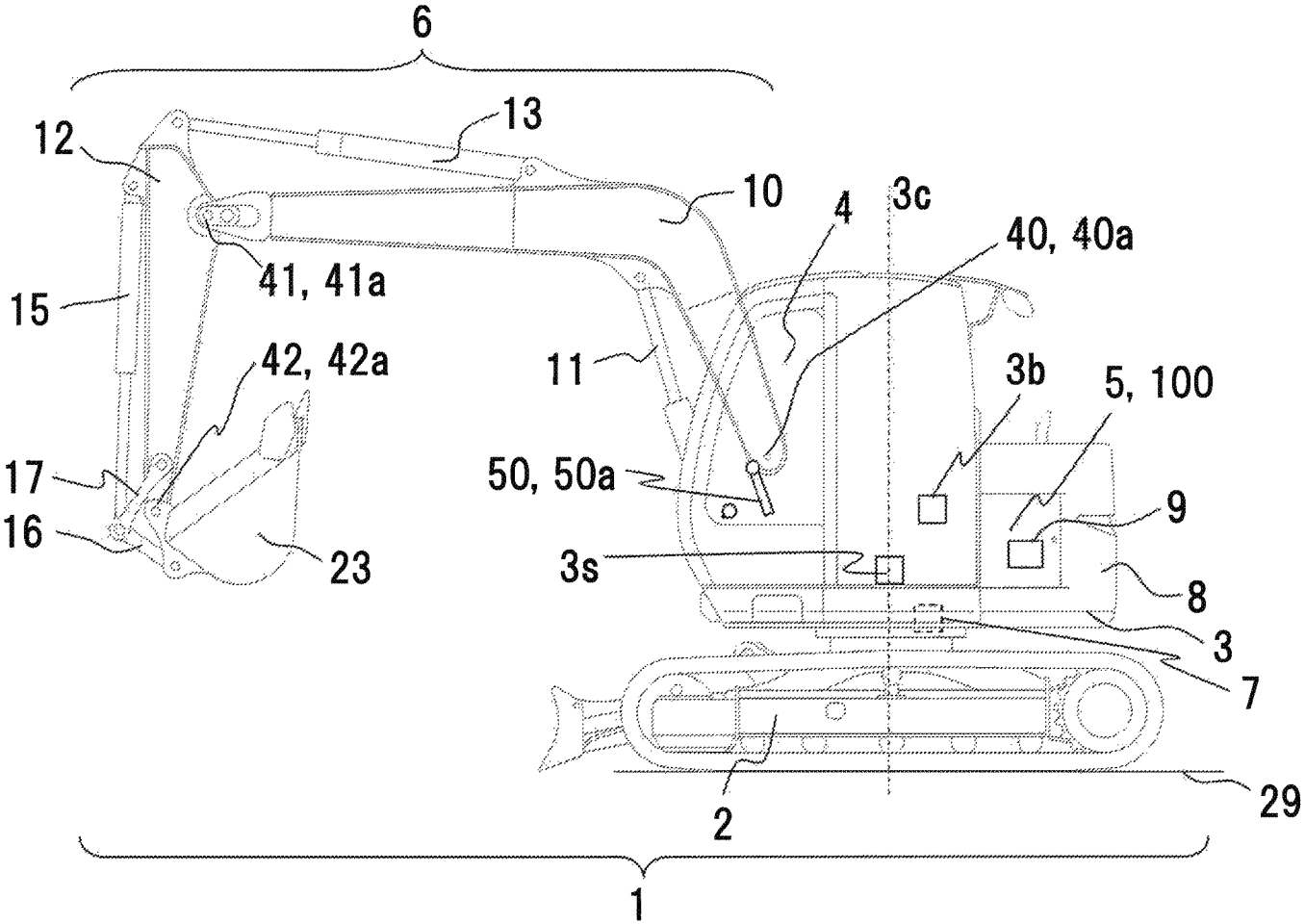
FIG. 1 is a side view of a work machine according to a first embodiment of the present invention.

As shown in FIG. 1, the work machine according to this embodiment includes a track structure 2, a swing structure 3 mounted on the top of the track structure 2 to be swingable, and a front work implement 6 formed of a multijoint link mechanism with an end connected to the swing structure 3.

The swing structure 3 is driven and swung around a central axis 3*c* by a swing motor 7. A cab 4 and a counter weight 8 are mounted on the swing structure 3. An engine 5 constituting a power system and an operation control system 9 formed of components such as a drive hydraulic circuit 100 for drive actuators (explained later) for controlling the startup/stoppage and the overall operation of the work machine 1 are arranged at appropriate positions in the swing structure 3.

The reference character 29 in FIG. 1 represents the ground surface.

The front work implement 6 includes a boom 10 (movable part) having an end connected to the swing structure 3, an arm 12 (movable part) having an end connected to the other end of the boom 10, and an attachment 23 (movable part) having an end connected to the other end of the arm 12. Each of these members is configured to rotate in the vertical direction.

A boom cylinder 11, as a drive actuator for rotating the boom 10 around a supporting point 40, is connected to the swing structure 3 and the boom 10. An arm cylinder 13, as a drive actuator for rotating the arm 12 around a supporting point 41, is connected to the boom 10 and the arm 12. An attachment cylinder 15, as a drive actuator for rotating the attachment 23 around a supporting point 42, is connected to the attachment 23 via a link 16 and to the arm 12 via a link 17. The attachment 23 can be arbitrarily replaced with an unshown work tool such as a magnet, a grapple, a cutter, a breaker or a bucket. The swing motor 7 is a drive actuator for driving the swing structure 3.

Provided in the cab 4 are a plurality of control levers 50 for letting the operator input commands in regard to the operation of each drive actuator.

Drive Hydraulic Circuit for Drive Actuators

Figure 2A:
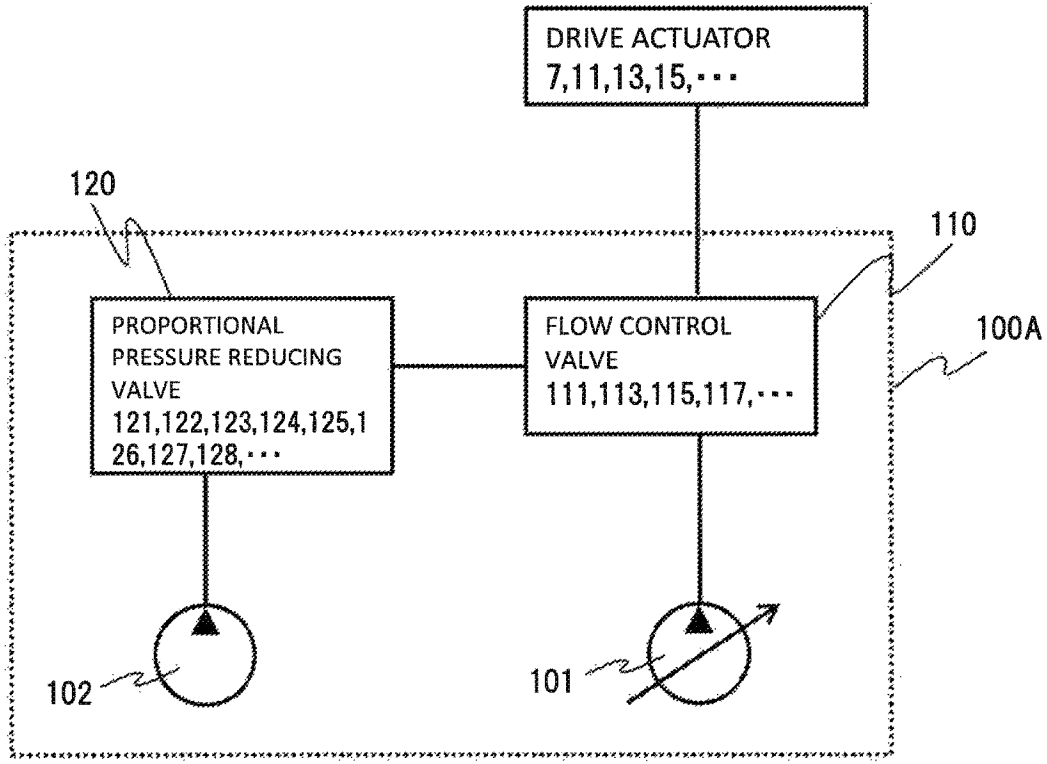
FIG. 2A is a conceptual diagram of a drive hydraulic circuit for drive actuators in a generally used work machine.

FIG. 2A is a conceptual diagram of the drive hydraulic circuit for the drive actuators in a generally used of work machine including hydraulic pilot type operating devices.

In FIG. 2A, each drive actuator 7, 11, 13, 15 of the work machine 1 is driven by hydraulic fluid supplied from a main pump 101. A drive hydraulic circuit 100A is a circuit for supplying the hydraulic fluid to the drive actuators 7, 11, 13 and 15. The drive hydraulic circuit 100A mainly includes the main pump 101 and a pilot pump 102 driven by the engine 5, a pilot type flow control valve set 110 connected to the main pump 101 to control the supply flow rates to the drive actuators, and a proportional pressure reducing valve set 120 connected to the pilot pump 102 to generate pilot hydraulic fluid to be supplied to the flow control valve set 110 according to operations on the control levers 50.

The flow control valve set 110 includes a boom flow control valve ill, an arm flow control valve 113, an attachment flow control valve 115, and a swing flow control valve 117. The proportional pressure reducing valve set 120 includes a boom expansion proportional pressure reducing valve 121, a boom contraction proportional pressure reducing valve 122, an arm expansion proportional pressure reducing valve 123, an arm contraction proportional pressure reducing valve 124, an attachment expansion proportional pressure reducing valve 125, an attachment contraction proportional pressure reducing valve 126, a right swing proportional pressure reducing valve 127, and a left swing proportional pressure reducing valve 128.

The driving method for driving a drive actuator is similar among all the drive actuators, and thus the following explanation will be given by taking the boom cylinder 11 as an example of the drive actuator.

Figure 2B:
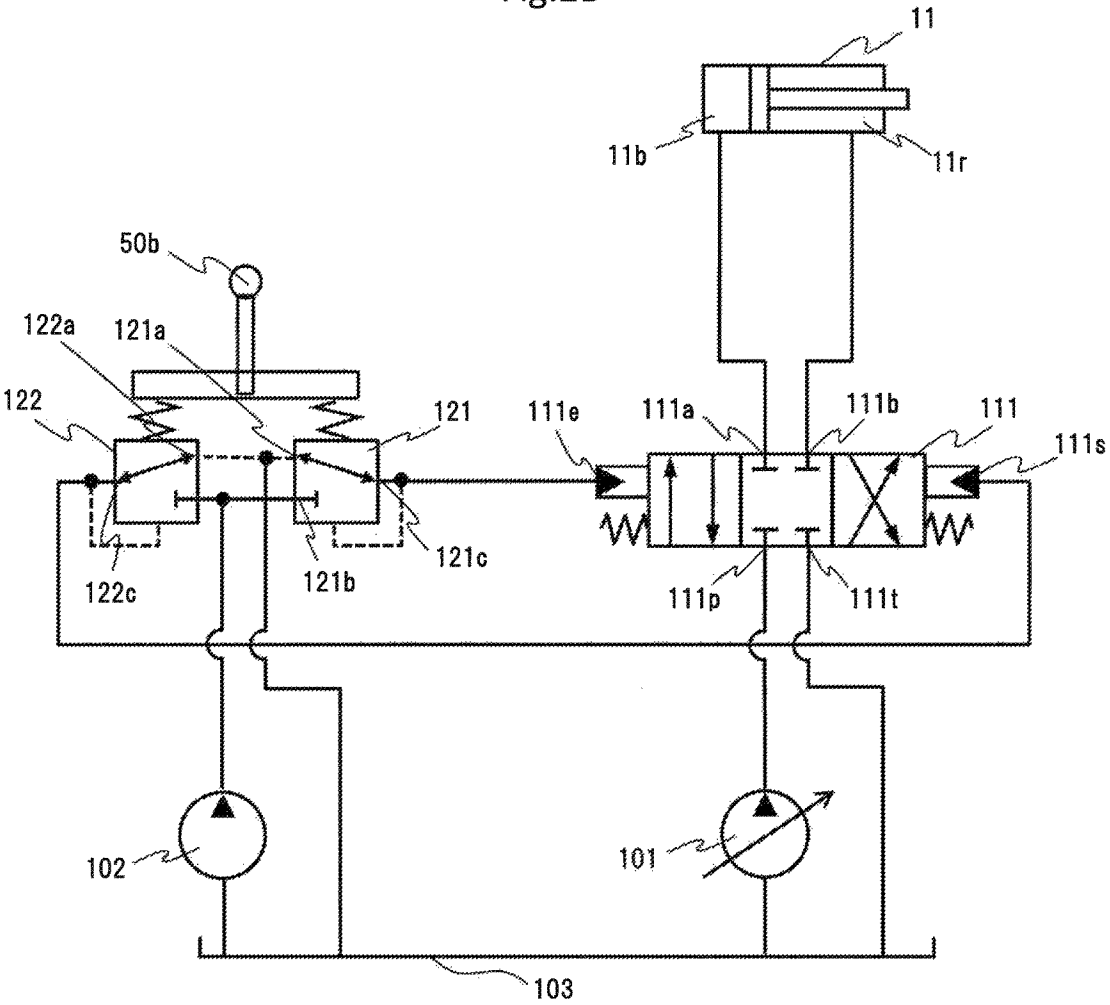
FIG. 2B is a schematic configuration diagram of a drive hydraulic circuit for a boom cylinder in a generally used work machine.

FIG. 2B is a schematic configuration diagram of the drive hydraulic circuit 100A for the boom cylinder 11 in a generally used work machine including hydraulic pilot type operating devices.

In FIG. 2B, a boom proportional pressure reducing valve is constituted of the boom expansion proportional pressure reducing valve 121 and the boom contraction proportional pressure reducing valve 122. Each proportional pressure reducing valve 121, 122 is driven by the operator's operation on a boom control lever 50*b* to the expansion side or the contraction side and generates the pilot hydraulic fluid at a pressure corresponding to the operation amount of the boom control lever 50*b* from the hydraulic fluid delivered from the pilot pump 102.

The boom expansion proportional pressure reducing valve 121 has a first port 121*a*, a second port 121*b*, and a third port 121*c*. The first port 121*a* is connected to a hydraulic fluid tank 103. The second port 121*b* is connected to the pilot pump 102. The third port 121*c* is connected to a boom expansion side pilot port 111*e* of the boom flow control valve 111 which will be explained later. When the boom control lever 50*b* is not operated to the expansion side, a valve passage for the communication between the first port 121*a* and the third port 121*c* fully opens and the second port 121*b* fully closes, and thus the hydraulic fluid from the pilot pump 102 is not supplied to the third port 121*c*. When the boom control lever 50*b* is operated to the expansion side, the proportional pressure reducing valve 121 is driven by the operation to open a valve passage for the communication between the second port 121*b* and the third port 121*c*, the pilot hydraulic fluid is supplied from the pilot pump 102 to the third port 121*c*, and the hydraulic fluid at a pressure corresponding to the lever operation amount is outputted from the third port 121*c*. When the boom control lever 50*b* is operated in a direction for returning from an operation state to a non-operation state, the boom expansion proportional pressure reducing valve 121 is driven in a direction for closing the valve passage for the communication between the second port 121*b* and the third port 121*c* and opening the valve passage for the communication between the first port 121*a* and the third port 121*c*. When the boom control lever 50*b* is returned to the non-operation state, the valve passage for the communication between the first port 121*a* and the third port 121*c* fully opens. At this point, the hydraulic fluid in the pilot hydraulic line connected to the third port 121*c* is discharged to the hydraulic fluid tank 103 through the valve passage for the communication between the first port 121*a* and the third port 121*c*.

The boom contraction proportional pressure reducing valve 122 has a configuration equivalent to the boom expansion proportional pressure reducing valve 121. When the boom control lever 50*b* is operated to the contraction side, the boom contraction proportional pressure reducing valve 122 is driven instead of the boom expansion proportional pressure reducing valve 121 and the hydraulic fluid at a pressure corresponding to the lever operation amount is outputted from a third port 122*c* of the boom contraction proportional pressure reducing valve 122. When the boom control lever 50*b* is operated in a direction for returning from the contraction side to the non-operation state, the hydraulic fluid in the pilot hydraulic line connected to the third port 122*c* of the boom contraction proportional pressure reducing valve 122 is discharged to the hydraulic fluid tank 103 through a valve passage for the communication between a first port 122*a* and the third port 122*c*.

The boom flow control valve 111 is a three-position selector valve of the pilot type having the boom expansion side pilot port 111*e* and a boom contraction side pilot port ills. The boom expansion side pilot port 111*e* is connected with the boom expansion proportional pressure reducing valve 121 via a boom expansion side pilot hydraulic line. The boom contraction side pilot port 111*s* is connected with the boom contraction proportional pressure reducing valve 122 via a boom contraction side pilot hydraulic line. Actuator side ports 111*a* and 111*b* of the boom flow control valve 111 are connected respectively to a bottom side hydraulic chamber 11*b* and a rod side hydraulic chamber 11*r* of the boom cylinder 11 via a boom expansion side main hydraulic line and a boom contraction side main hydraulic line. A pump port 111*p* and a tank port 111*t* of the boom flow control valve 111 are connected respectively to the main pump 101 and the hydraulic fluid tank 103.

When the pilot hydraulic fluid is supplied to neither the boom expansion side pilot port 111*e* nor the boom contraction side pilot port ills of the boom flow control valve 111, the boom flow control valve 111 is positioned at its neutral position. In this case, the supply of the hydraulic fluid to the boom cylinder 11 and the discharge of the hydraulic fluid from the boom cylinder 11 are not conducted. When the boom control lever 50*b* is operated to the expansion side and the pilot hydraulic fluid is supplied to the boom expansion side pilot port 111*e*, the boom flow control valve 111 switches to an expansion drive position and the hydraulic fluid from the main pump 101 is supplied to the bottom side hydraulic chamber 11*b* of the boom cylinder 11, by which the boom cylinder 11 is driven to expand. In contrast, when the boom control lever 50*b* is operated to the contraction side, the pilot hydraulic fluid is supplied to the boom contraction side pilot port ills, the boom flow control valve 111 switches to a contraction drive position, and the hydraulic fluid from the main pump 101 is supplied to the rod side hydraulic chamber 11*r* of the boom cylinder 11, by which the boom cylinder 11 is driven to contract. In these cases, the opening area of the boom flow control valve 111 is determined by the pressure of the pilot hydraulic fluid supplied to each pilot port 111*e*, 111*s*, and the boom cylinder 11 is driven to expand/contract at a speed corresponding to the pressure of the pilot hydraulic fluid.

Stabilization Control

The work machine 1 according to this embodiment is equipped with a stabilization control system 190 for preventing destabilization during the work. The operator conducts various types of work with the work machine 1 by operating the control levers 50. However, the stability deteriorates when the work is performed with the front work implement 6 expanded and when the load applied to the attachment 23 is high. Further, the operator's quick operation causes great inertial force exerted on the work machine 1 due to a sharp change in speed, and the stability of the work machine 1 changes significantly under the influence of the inertial force. Especially at times of sudden stoppage operation in which the operator instantaneously returns a control lever 50 from the operation state to a stop command state, great inertial force works on the work machine 1 in an overturn direction and the work machine 1 tends to be destabilized.

The stabilization control system 190 in this embodiment is a device for limiting the operation of the drive actuators based on stability evaluation so that the work machine 1 is not destabilized even when the operator performed a forceful or erroneous operation. Further, in consideration of the significant deterioration in the stability caused by the sudden stoppage operation, the stabilization control system 190 in this embodiment performs a gradual stoppage and operation speed limitation as operation limitation for keeping the work machine 1 stable.

Here, the gradual stoppage is a function of limiting the deceleration of a movable part at times of the stop operation and thereby making the movable part stop gradually. The operation speed limitation is a function of limiting the maximum speed of a drive actuator. Introducing the gradual stoppage into the control makes it possible to restrain the inertial force occurring at times of the sudden stoppage operation and to prevent the instability of the work machine 1 due to great inertial force caused by the sudden stoppage. On the other hand, performing the gradual stoppage leads to an increase in the braking distance. Therefore, it is necessary to previously determine a permissible braking distance and set a stoppage characteristic so that the stoppage is completed within the permissible braking distance. Therefore, the stabilization control system 190 in this embodiment performs the gradual stoppage as needed within the previously determined permissible braking distance, while also limiting the operation speed so that the work can be performed stably within the permissible braking distance in any state of operation.

The stabilization control system 190 is configured to perform the operation limitation on every drive actuator installed in the work machine 1. However, the following explanation will be given by taking an example of a case where the operation limitation is applied only to the boom cylinder 11 and the arm cylinder 13 having an especially great influence on the stability of the work machine 1.

Figure 3:
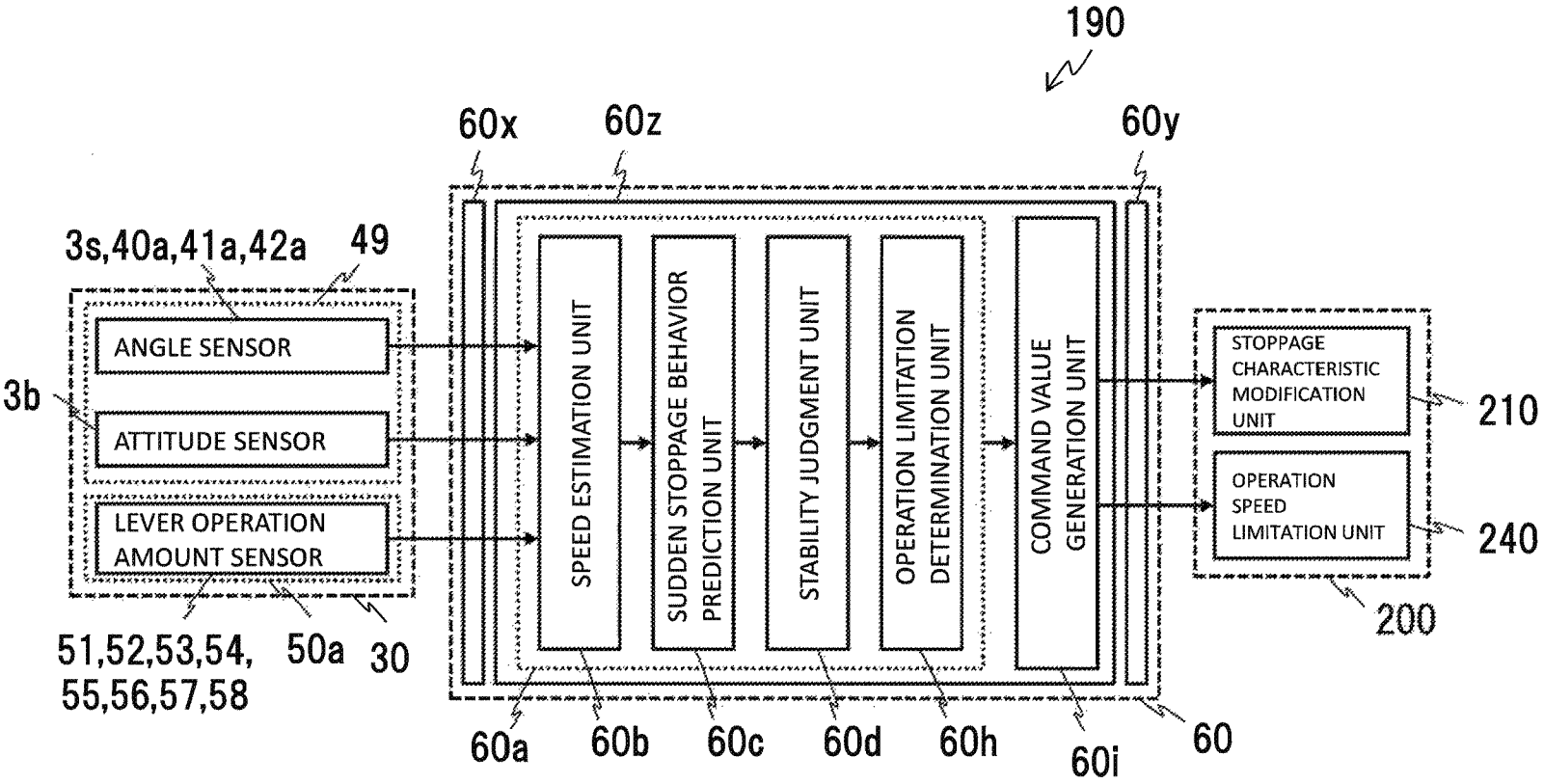
FIG. 3 is a schematic configuration diagram of a stabilization control system according to the first embodiment.

FIG. 3 is a schematic configuration diagram of the stabilization control system 190 in this embodiment.

In FIG. 3, the stabilization control system 190 is mainly composed of a state quantity detection unit 30, a calculation device 60, and a pilot pressure correction unit 200.

The state quantity detection unit 30 includes sensors attached to various parts of the work machine 1 to detect state quantities of the work machine 1.

The calculation device 60 is formed of an unshown CPU (Central Processing Unit), an unshown storage device, etc. The calculation device 60 performs stabilization control calculation based on detection signals from the state quantity detection unit 30, thereby calculates the operation limitation on the boom cylinder 11 and the arm cylinder 13 necessary for keeping the work machine 1 stable, and outputs drive commands to the pilot pressure correction unit 200.

The pilot pressure correction unit 200 is a hydraulic device for correcting the pressure of the pilot hydraulic fluid generated according to the operator's lever operation so as to satisfy the operation limitation calculated by the calculation device 60. The pilot pressure correction unit 200 is provided in a pilot hydraulic line connecting the flow control valve set 110 and the proportional pressure reducing valve set 120.

The details of each unit will be explained below.

State Quantity Detection Unit

Principal parts of the work machine 1 are equipped with sensors for detecting the state quantities of the machine as the state quantity detection unit 30. In the following, the details of the state quantity detection unit 30 installed in the work machine 1 according to this embodiment will be explained with reference to FIGS. 1 and 3.

The state quantity detection unit 30 in this embodiment includes an attitude detection unit 49 for detecting the attitude of the work machine 1 and a lever operation amount detection unit 50*a* for detecting the level of an operation command from the operator to each drive actuator.

The attitude detection unit 49, as a functional block for detecting the attitude of the work machine 1, includes an attitude sensor 3*b* and angle sensors 3*s*, 40*a*, 41*a* and 42*a*. The swing structure 3 is equipped with the attitude sensor 3*b* for detecting the inclination of the work machine 1. A swing angle sensor 3*s* for detecting the swing angle between the track structure 2 and the swing structure 3 is provided on the central axis 3*c* of the swing structure 3. A boom angle sensor 40*a* for measuring the rotation angle of the boom 10 is provided at the supporting point 40 between the swing structure 3 and the boom 10. An arm angle sensor 41*a* for measuring the rotation angle of the arm 12 is provided at the supporting point 41 between the boom 10 and the arm 12. An attachment angle sensor 42*a* is provided at the supporting point 42 between the arm 12 and the attachment 23.

The lever operation amount detection unit 50*a*, as a functional block for detecting the level of an operation command from the operator to each drive actuator of the work machine 1, is equipped with lever operation amount sensors for detecting the operation amounts of the control levers 50. In the aforementioned hydraulic pilot type operating devices, when the operator operates a control lever 50, a corresponding proportional pressure reducing valve in the proportional pressure reducing valve set 120 is driven and the pilot hydraulic fluid at a pressure corresponding to the lever operation amount is outputted. Therefore, the level of each operation command from the operator can be detected by providing pressure sensors for detecting the pressures of the hydraulic fluid outputted from the proportional pressure reducing valves.

More specifically, the lever operation amount detection unit 50*a* is equipped with a boom expansion operation amount sensor 51 for detecting the pressure of the hydraulic fluid outputted from the boom expansion proportional pressure reducing valve 121, a boom contraction operation amount sensor 52 for detecting the pressure of the hydraulic fluid outputted from the boom contraction proportional pressure reducing valve 122, an arm expansion operation amount sensor 53 for detecting the pressure of the hydraulic fluid outputted from the arm expansion proportional pressure reducing valve 123, an arm contraction operation amount sensor 54 for detecting the pressure of the hydraulic fluid outputted from the arm contraction proportional pressure reducing valve 124, an attachment expansion operation amount sensor 55 for detecting the pressure of the hydraulic fluid outputted from the attachment expansion proportional pressure reducing valve 125, an attachment contraction operation amount sensor 56 for detecting the pressure of the hydraulic fluid outputted from the attachment contraction proportional pressure reducing valve 126, a right swing operation amount sensor 57 for detecting the pressure of the hydraulic fluid outputted from the right swing proportional pressure reducing valve 127, and a left swing operation amount sensor 58 for detecting the pressure of the hydraulic fluid outputted from the left swing proportional pressure reducing valve 128.

Pilot Pressure Correction Unit

The pilot pressure correction unit 200 is a functional block for correcting the pressure of the pilot hydraulic fluid outputted from the proportional pressure reducing valve set 120 according to the operator's lever operation to a pressure satisfying the operation limitation commanded by a stabilization control calculation unit 60*a* of the calculation device 60 which will be explained later. The stabilization control system 190 in this embodiment performs the gradual stoppage, modifying the stoppage characteristic and thereby making a movable part stop gradually, and the operation speed limitation, setting an upper limit to the operation speed, as the operation limitation for the stabilization. To carry out the two types of operation limitation, the pilot pressure correction unit 200 includes a stoppage characteristic modification unit 210 and an operation speed limitation unit 240.

Figure 5A:
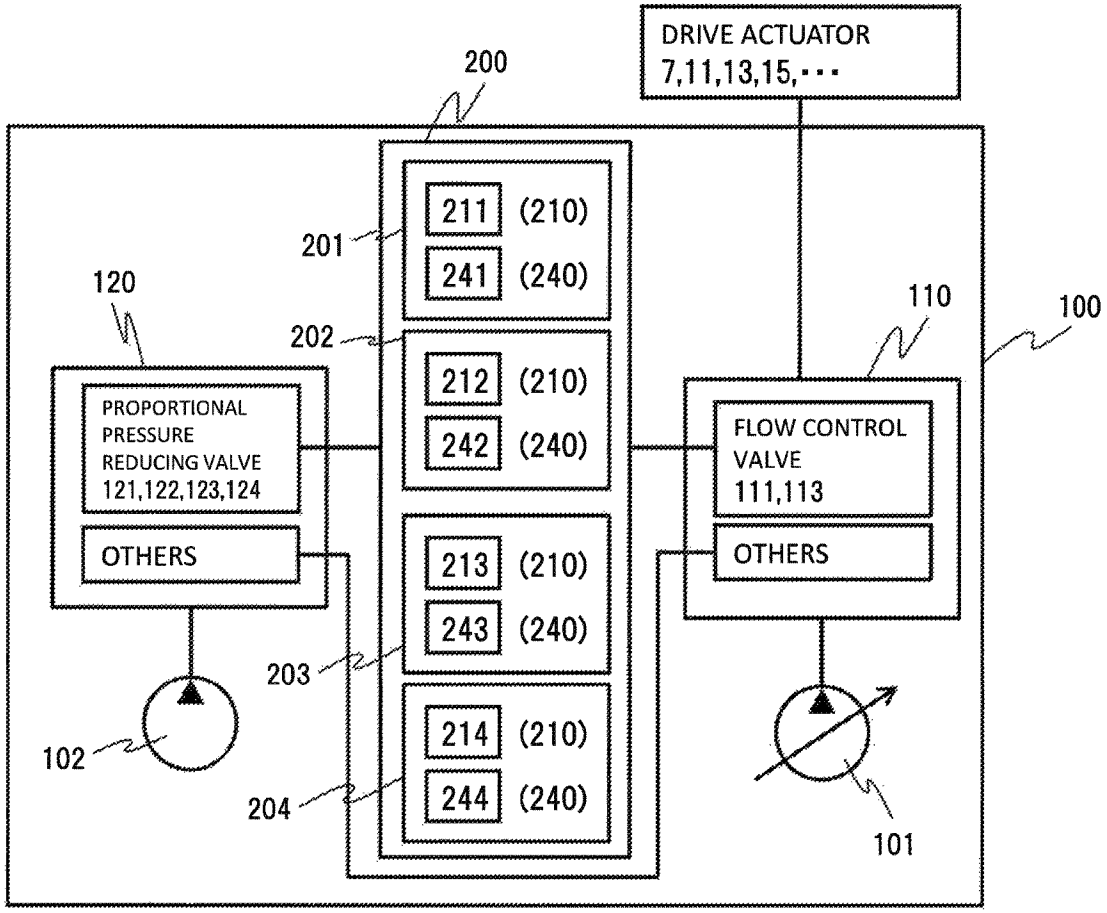
FIG. 5A is a conceptual diagram of a drive hydraulic circuit for the drive actuators in the work machine according to the first embodiment.

FIG. 5A is a conceptual diagram of the drive hydraulic circuit for the drive actuators, including the pilot pressure correction unit 200, in the stabilization control system 190 in this embodiment.

In the case where the operation limitation based on the stabilization control calculation is applied to the boom cylinder 11 and the arm cylinder 13, the work machine 1 is provided with a boom expansion pilot pressure correction unit 201, a boom contraction pilot pressure correction unit 202, an arm expansion pilot pressure correction unit 203 and an arm contraction pilot pressure correction unit 204 as the pilot pressure correction unit 200 as shown in FIG. 5A.

The boom expansion pilot pressure correction unit 201 includes a boom expansion stoppage characteristic modification unit 211 and a boom expansion operation speed limitation unit 241. The boom contraction pilot pressure correction unit 202 includes a boom contraction stoppage characteristic modification unit 212 and a boom contraction operation speed limitation unit 242. The arm expansion pilot pressure correction unit 203 includes an arm expansion stoppage characteristic modification unit 213 and an arm expansion operation speed limitation unit 243. The arm contraction pilot pressure correction unit 204 includes an arm contraction stoppage characteristic modification unit 214 and an arm contraction operation speed limitation unit 244. These pilot pressure correction units 201, 202, 203 and 204 are equivalent in the configuration, and thus the details of the boom expansion pilot pressure correction unit 201 will be explained below with reference to FIG. 5B by taking the correction of boom expansion pilot hydraulic fluid as an example.

As mentioned above, the operation of the boom cylinder 11 is determined by the pressures of the pilot hydraulic fluid supplied to the pilot ports 111*e* and 111*s* of the boom flow control valve 111. Therefore, introducing a certain type of control and performing expansion driving on the boom cylinder 11 based on the control calculation result can be implemented by providing the pilot pressure correction unit 201, for correcting the pressure of the pilot hydraulic fluid outputted from the proportional pressure reducing valve 121 according to the lever operation and thereby generating hydraulic pressure satisfying the control calculation result, in the pilot hydraulic line for supplying the pilot hydraulic fluid to the boom expansion side pilot port ille of the boom flow control valve 111. In the following description, the pilot hydraulic fluid outputted from the proportional pressure reducing valve 121 according to the lever operation will be referred to as "lever operation pilot hydraulic fluid," the pressure of the lever operation pilot hydraulic fluid will be referred to as "lever operation pilot pressure," the pilot hydraulic fluid after being corrected by the pilot pressure correction unit 201 will be referred to as "corrected pilot hydraulic fluid," and the pressure of the corrected pilot hydraulic fluid will be referred to as "corrected pilot pressure."

As a method for generating a desirable pilot pressure based on the control calculation result, a solenoid proportional valve for decompressing the hydraulic fluid from the pilot pump 102 according to an electric command and outputting the decompressed hydraulic fluid can be provided in the pilot hydraulic line connecting the pilot pump 102 and the boom flow control valve 111. With a configuration for driving the solenoid proportional valve according to the control calculation result and supplying the pilot hydraulic fluid outputted from the solenoid proportional valve to the boom flow control valve 111 instead of the pilot hydraulic fluid outputted from the proportional pressure reducing valve 121, for example, the pilot hydraulic fluid at a desirable pressure can be supplied to the boom flow control valve ill. With such features, the hydraulic fluid from the added solenoid proportional valve is supplied to the boom flow control valve 111 irrespective of whether the correction for the lever operation pilot hydraulic fluid is necessary or not.

Meanwhile, in the case where the pilot pressure correction unit 201 is employed, the circuit has to be configured not to impair the conventional operability. In the aforementioned configuration employing the solenoid proportional valve, the pilot hydraulic fluid is supplied to the boom flow control valve 111 in a configuration constantly different from the conventional configuration, and thus there is a danger of a change in the responsiveness or the like, causing a strange operational feel or a feeling of strangeness to the operator. In order to maintain the conventional operability, it is desirable to employ a configuration for correcting the lever operation pilot pressure only when the correction is necessary, while supplying the lever operation pilot hydraulic fluid outputted from the proportional pressure reducing valve 121, for example, to the pilot port ille of the boom flow control valve 111 similarly to the case of not employing the pilot pressure correction unit 201 when the correction is unnecessary. Therefore, in this embodiment, the pilot pressure correction unit 201 is configured so as to take advantage of the conventional pilot hydraulic fluid supply circuit employing the proportional pressure reducing valve 121 while making the correction to the lever operation pilot pressure only when the operation limitation is judged to be necessary by the stabilization control calculation.

Figure 4A:
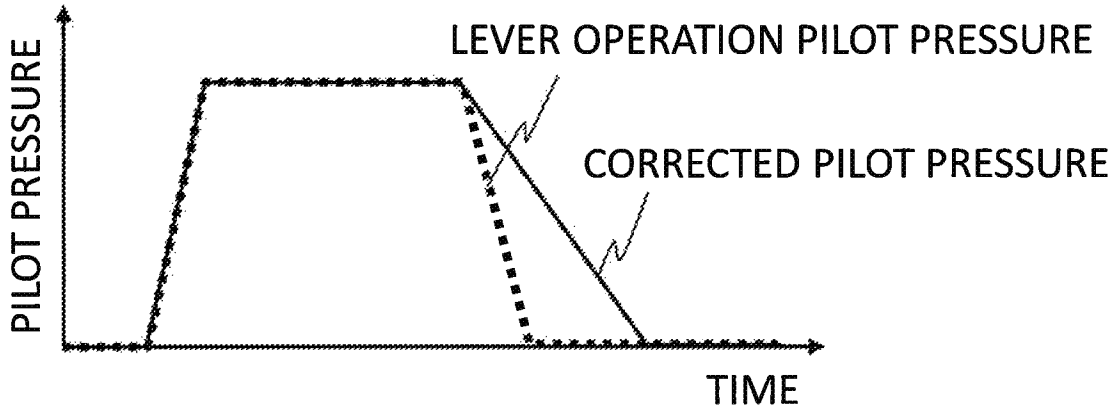
FIG. 4A is a graph showing an example of pilot pressure correction made by a pilot pressure correction unit in the first embodiment to perform gradual stoppage.
Figure 4B:
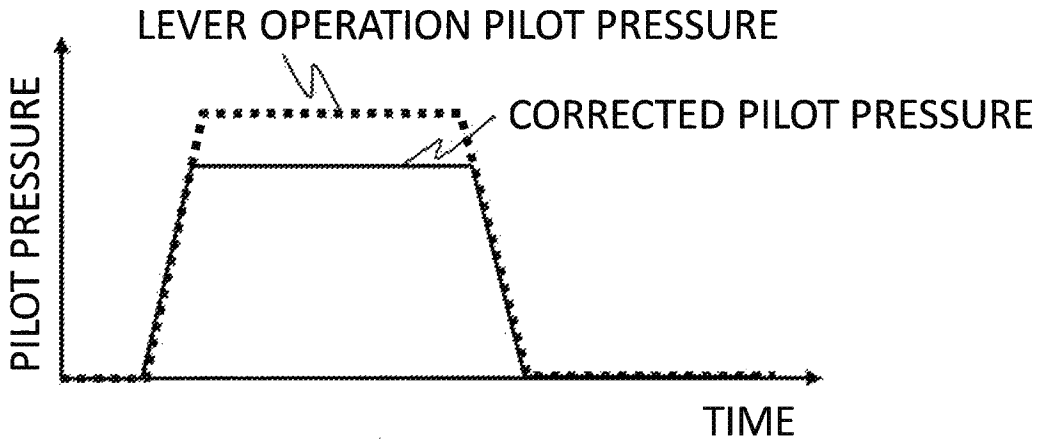
FIG. 4B is a graph showing an example of pilot pressure correction made by the pilot pressure correction unit in the first embodiment to perform operation speed limitation.

The operation limitation performed in the stabilization control system 190 in this embodiment is constituted of the gradual stoppage, modifying the stoppage characteristic and thereby making a movable part stop gradually, and the operation speed limitation, setting an upper limit to the operation speed. In order to perform the gradual stoppage, a correction has to be made so as to achieve a gradual pressure drop when the lever operation pilot pressure drops sharply. Meanwhile, in order to perform the operation speed limitation, an upper limit pressure has to be set for the lever operation pilot pressure. FIG. 4A shows an example of a correction for performing the gradual stoppage. FIG. 4B shows an example of a correction for performing the operation speed limitation.

The pilot pressure correction unit 201 in this embodiment includes the stoppage characteristic modification unit 211 and the operation speed limitation unit 241 in order to perform the aforementioned two types of operation limitation (gradual stoppage, operation speed limitation). The lever operation pilot hydraulic fluid outputted from the proportional pressure reducing valve 121 is first inputted to the stoppage characteristic modification unit 211 and undergoes a correction so as to satisfy a stoppage characteristic of the gradual stoppage commanded by the stabilization control calculation performed in the calculation device 60. The pilot hydraulic fluid after undergoing the correction by the stoppage characteristic modification unit 211 is inputted to the operation speed limitation unit 241 and undergoes a correction so as to satisfy the operation speed limitation commanded by the stabilization control calculation performed in the calculation device 60. The pilot hydraulic fluid after undergoing the correction by the operation speed limitation unit 241 is inputted to the boom expansion side pilot port ille of the corresponding boom flow control valve 111.

In the pilot pressure correction unit 201 in this embodiment, the stoppage characteristic modification unit 211 includes a gradual stoppage solenoid proportional valve 221 and a gradual stoppage high pressure selection unit 231. The operation speed limitation unit 241 includes a speed limitation solenoid proportional valve 251. The gradual stoppage solenoid proportional valve 221 and the speed limitation solenoid proportional valve 251 are driven by command signals outputted from the calculation device 60 which will be explained later.

Stoppage Characteristic Modification Unit

The boom expansion stoppage characteristic modification unit 211 in this embodiment includes the gradual stoppage solenoid proportional valve 221 and the gradual stoppage high pressure selection unit 231 as mentioned above.

The gradual stoppage solenoid proportional valve 221 is a valve that is driven by the command from the calculation device 60 and generates pilot hydraulic fluid for performing the gradual stoppage (gradual stoppage pilot hydraulic fluid) commanded by the stabilization control calculation unit 60*a* of the calculation device 60 from the hydraulic fluid delivered from the pilot pump 102. The gradual stoppage high pressure selection unit 231 is a functional block for selecting hydraulic fluid on the high pressure side from the lever operation pilot hydraulic fluid and the gradual stoppage pilot hydraulic fluid and outputting the selected hydraulic fluid.

The gradual stoppage solenoid proportional valve 221 has a first port 221*a*, a second port 221*b*, a third port 221*c*, and a solenoid 221*d*. The first port 221*a* is connected with the hydraulic fluid tank 103, while the second port 221*b* is connected with the pilot pump 102. When the solenoid 221*d* is excited by a command signal from the calculation device 60, the gradual stoppage pilot hydraulic fluid at a pressure corresponding to the command signal is outputted to the third port 221*c*. The gradual stoppage solenoid proportional valve 221 has a normally closed characteristic in which a valve passage for the communication between the first port 221*a* and the third port 221*c* is fully open, the second port 221*b* is fully closed, and the supply of the hydraulic fluid from the pilot pump 102 is interrupted when the solenoid 221*d* is not excited. Thus, when the solenoid 221*d* is in the unexcited state, the pressure on the third port 221*c* side equals the tank pressure. When the solenoid 221*d* is excited by a command signal from the calculation device 60, the gradual stoppage solenoid proportional valve 221 is driven in a direction for opening a valve passage for the communication between the second port 221*b* and the third port 221*c* and the hydraulic fluid from the pilot pump 102 is outputted to the third port 221*c*. The gradual stoppage solenoid proportional valve 221 has such a characteristic that the pressure of the hydraulic fluid outputted from the third port 221*c* increases with the increase in the magnitude of the command signal given to the solenoid 221*d*. Therefore, the calculation device 60 is desired to issue drive commands to the solenoid 221*d* in such a manner as to set the pressure of the hydraulic fluid from the third port 221*c* at a pressure satisfying the stoppage characteristic of the gradual stoppage commanded by the stabilization control calculation unit 60*a*.

The gradual stoppage high pressure selection unit 231 is implemented by a shuttle valve, for example. The lever operation pilot hydraulic fluid outputted from the proportional pressure reducing valve 121 and the gradual stoppage pilot hydraulic fluid outputted from the gradual stoppage solenoid proportional valve are inputted to the gradual stoppage high pressure selection unit 231. The gradual stoppage high pressure selection unit 231 selects hydraulic fluid on the high pressure side from the lever operation pilot hydraulic fluid and the gradual stoppage pilot hydraulic fluid inputted thereto and outputs the selected hydraulic fluid as the output of the stoppage characteristic modification unit 211.

When the lever operation pilot pressure drops more sharply than the stoppage characteristic of the gradual stoppage commanded by the stabilization control calculation unit 60*a*, the gradual stoppage pilot pressure becomes higher than the lever operation pilot pressure and the gradual stoppage pilot pressure is selected by the gradual stoppage high pressure selection unit 231, by which the gradual stoppage with the commanded stoppage characteristic is realized. In contrast, when the operator's operation is performed in such a manner as to cause a more gradual stoppage than the stoppage characteristic commanded by the stabilization control calculation unit 60*a*, the lever operation pilot pressure drops more gradually than the gradual stoppage pilot pressure, that is, the lever operation pilot pressure is higher than the gradual stoppage pilot pressure, and the lever operation pilot pressure is selected by the gradual stoppage high pressure selection unit 231. Thus, in this case, the lever operation pilot hydraulic fluid is outputted from the stoppage characteristic modification unit 211 without being corrected. The correction of the pressure of the pilot hydraulic fluid by the stoppage characteristic modification unit 211 is made only in cases where the operator's operation is performed in such a manner as to cause the operation speed to drops sharply, and thus the gradual stoppage solenoid proportional valve 221 is not driven at times of steady motion command operation, acceleration operation, etc. Thus, even at times of such operations, the lever operation pilot hydraulic fluid is selected by the gradual stoppage high pressure selection unit 231 and is outputted from the stoppage characteristic modification unit 211 without being corrected.

Operation Speed Limitation Unit

In this embodiment, the speed limitation solenoid proportional valve 251 is employed as the boom expansion operation speed limitation unit 241 as mentioned above. The speed limitation solenoid proportional valve 251 sets the upper limit pressure for the pilot hydraulic fluid supplied to the boom flow control valve 111 so as to satisfy the operation speed limitation commanded by the stabilization control calculation unit 60*a* of the calculation device 60.

Figure 5B:
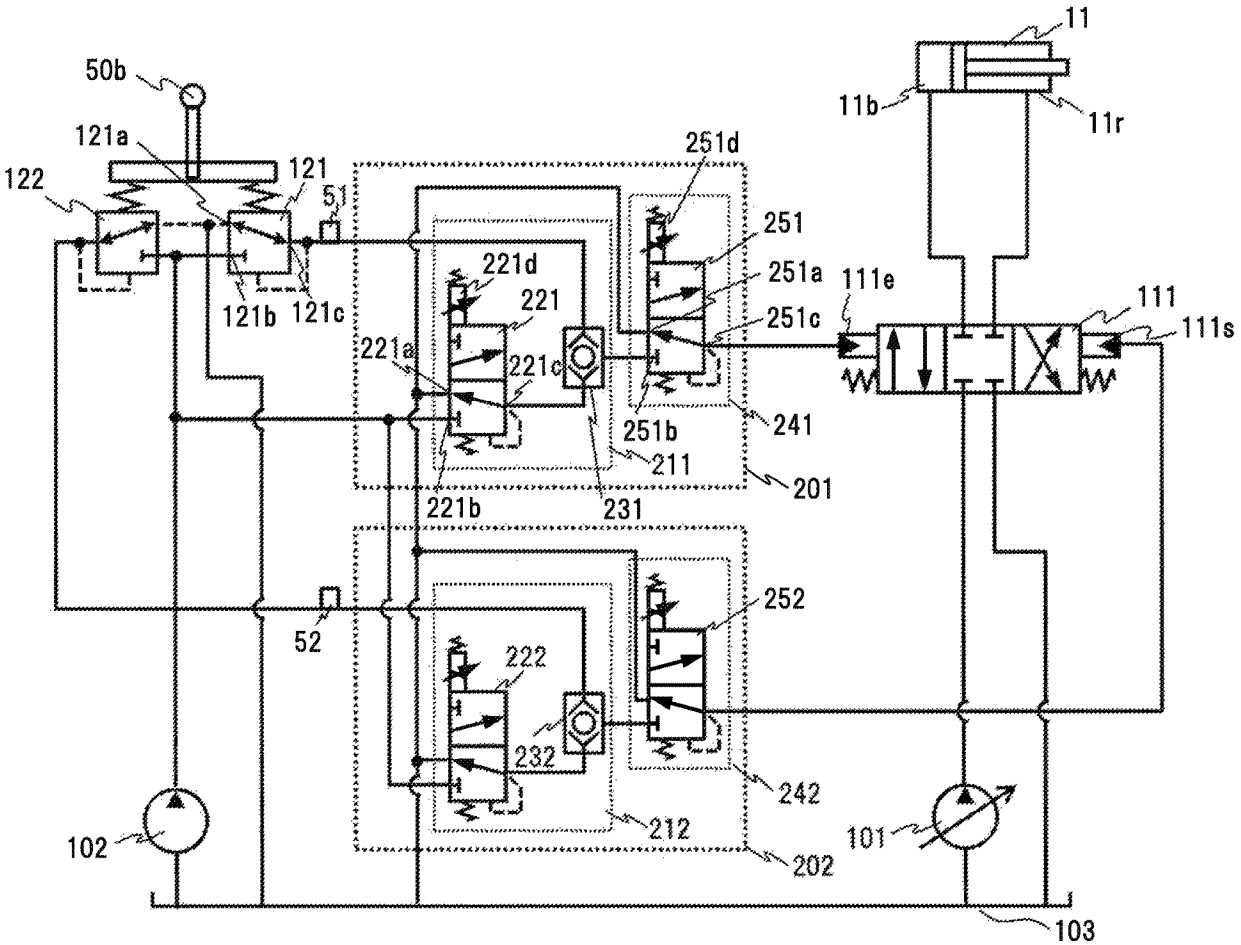
FIG. 5B is a schematic configuration diagram of a drive hydraulic circuit for a boom cylinder in the work machine according to the first embodiment.

As shown in FIG. 5B, the speed limitation solenoid proportional valve 251 has a first port 251*a*, a second port 251*b*, a third port 251*c*, and a solenoid 251*d*. The first port 251*a* is connected with the hydraulic fluid tank 103. The second port 251*b* is connected with the output port of the gradual stoppage high pressure selection unit 231. The third port 251*c* is connected with the boom expansion side pilot port 111*e* of the boom flow control valve 111. The hydraulic fluid outputted from the third port 251*c* is the corrected pilot hydraulic fluid outputted by the pilot pressure correction unit 201.

Similarly to the gradual stoppage solenoid proportional valve 221, the speed limitation solenoid proportional valve 251 has a normally closed characteristic in which a valve passage for the communication between the first port 251*a* and the third port 251*c* is fully open and the second port 251*b* is fully closed when the solenoid 251*d* is not excited. Thus, when the solenoid 251*d* is not excited, communication is established between the boom expansion side pilot port 111*e* of the boom flow control valve 111 and the hydraulic fluid tank 103 and the corrected pilot pressure equals the tank pressure. In contrast, when the solenoid 251*d* is excited by a command signal from the calculation device 60, the speed limitation solenoid proportional valve 251 is driven in a direction for opening a valve passage for the communication between the second port 251*b* and the third port 251*c* and the pilot hydraulic fluid supplied from the stoppage characteristic modification unit 211 to the second port 251*b* is outputted to the third port 251*c*. The pressure of the hydraulic fluid flowing through the valve passage for the communication between the second port 251*b* and the third port 251*c* is determined by the magnitude of the command signal given to the solenoid 251*d*. Here, the amount determined by the command signal is the upper limit pressure of the hydraulic fluid flowing through the valve passage. The corrected pilot pressure equals the lower one selected from the pressure of the hydraulic fluid supplied to the second port 251*b* and the upper limit pressure determined by the command signal given to the solenoid 251*d*. In cases where the maximum command signal is given to the solenoid 251*d*, the valve passage for the communication between the second port 251*b* and the third port 251*c* fully opens and the corrected pilot pressure becomes equal to the output pressure of the stoppage characteristic modification unit 211 irrespective of the pressure of the hydraulic fluid supplied to the second port 251*b*. When the output pressure of the stoppage characteristic modification unit 211 is higher than the upper limit pressure satisfying the operation speed limitation commanded by the stabilization control calculation unit 60*a*, the pilot hydraulic fluid is decompressed by the speed limitation solenoid proportional valve 251 and the commanded operation speed limitation is implemented. In contrast, when the output pressure of the stoppage characteristic modification unit 211 is lower than the upper limit pressure, the pilot hydraulic fluid is not corrected by the speed limitation solenoid proportional valve 251 and the pilot hydraulic fluid outputted from the stoppage characteristic modification unit 211 is supplied to the boom expansion side pilot port ille of the boom flow control valve 111. Also when no operation speed limitation command is issued by the stabilization control calculation unit 60*a*, the pilot hydraulic fluid is not corrected by the speed limitation solenoid proportional valve 251.

As explained above, in order to perform the commanded gradual stoppage, the stoppage characteristic modification unit 211 in this embodiment outputs the gradual stoppage pilot hydraulic fluid by use of the gradual stoppage solenoid proportional valve 221 only when the correction of the lever operation pilot hydraulic fluid is necessary. When the correction is unnecessary, the stoppage characteristic modification unit 211 outputs the lever operation pilot hydraulic fluid outputted from the proportional pressure reducing valve 121 similarly to the conventional pilot hydraulic fluid supply circuit.

In order to perform the commanded operation speed limitation, the operation speed limitation unit 241 in this embodiment decompresses the pilot hydraulic fluid supplied from the stoppage characteristic modification unit 211 by use of the speed limitation solenoid proportional valve 251 only when the correction of the pilot hydraulic fluid is necessary. When the correction is unnecessary, the boom expansion operation speed limitation unit 241 directly outputs the pilot hydraulic fluid supplied from the stoppage characteristic modification unit 211. Thus, when no gradual stoppage command or operation speed limitation command is issued or the lever operation pilot pressure satisfies the gradual stoppage command and the operation speed limitation command, the lever operation pilot pressure is not corrected by the stoppage characteristic modification unit 211 or the operation speed limitation unit 241, and the lever operation pilot hydraulic fluid outputted from the proportional pressure reducing valve 121 is supplied to the boom expansion side pilot port 111*e* of the boom flow control valve 111 similarly to the case of the conventional pilot hydraulic fluid supply circuit. By employing such a configuration taking advantage of the conventional pilot hydraulic fluid supply circuit, the operation limitation can be performed without affecting the conventional operability.

Calculation Device

The calculation device 60 is formed of a microcomputer including an unshown CPU, a storage unit including a ROM (Read Only Memory), a RAM (Random Access Memory), a flash memory, etc., an unshown peripheral circuit, and so forth. The calculation device 60 operates according to a program stored in the ROM, for example.

The calculation device 60 includes an input unit 60*x* to which signals from sensors attached to various parts of the work machine 1 are inputted, a calculation unit 60*z* that receives the signals inputted to the input unit 60*x* and performs prescribed calculations, and an output unit 60*y* that receives output signals from the calculation unit 60*z* and outputs drive commands to the pilot pressure correction unit 200.

Calculation Unit

The details of the calculation unit 60*z* will be described below with reference to FIG. 3.

The calculation unit 60*z* includes the stabilization control calculation unit 60*a* for calculating the operation limitation necessary for keeping the work machine 1 stable according to signals taken in from the state quantity detection unit 30, and a command value generation unit 60*i* for calculating the drive commands for the pilot pressure correction unit 200 based on the output from the stabilization control calculation unit 60*a*.

Stabilization Control Calculation Unit

As mentioned above, the stabilization control system 190 in this embodiment performs the gradual stoppage and the operation speed limitation as the operation limitation for keeping the work machine 1 stable. The stabilization control calculation unit 60*a* evaluates the stability of the work machine 1 based on the result of the detection by the state quantity detection unit 30, judges whether the operation limitation is necessary or not based on the result of the stability evaluation, and outputs a gradual stoppage command value and an operation speed limitation value when the operation limitation is necessary.

While various methods can be employed for the stability evaluation of the work machine 1 and the determination of the operation limitation, the following explanation in this embodiment will be given by taking an example of a case where the operation limitation is calculated based on sudden stoppage behavior prediction, that is, prediction of behavior at times of sudden stoppage, by using a ZMP (Zero Moment Point) as a stability evaluation index.

As mentioned above, at times of sudden stoppage operation in which the operator instantaneously returns a control lever 50 from the operation state to the stop command state, great inertial force works on the work machine 1 in an overturn direction and the work machine 1 tends to be destabilized. Therefore, the stabilization control calculation unit 60*a* in this embodiment predicts the behavior of the work machine 1 on the assumption that a sudden stoppage operation will be performed, and determines the operation limitation so that the stable state is maintained even at times of sudden stoppage operation.

There are two methods for calculating the operation limitation for keeping the work machine 1 stable: a method by an inverse operation from stability conditions and a method by a normal operation in which the behavior prediction and the stability evaluation are repeated multiple times while changing the operation limitation employed. The former method has an advantage in that the optimum operation limitation can be calculated by one operation, while having a disadvantage in that a complicated arithmetic equation has to be derived. In contrast, the latter method has a disadvantage in that multiple trials are necessary, while having an advantage in that a relatively simple arithmetic equation can be used. The following explanation will be given by taking the latter method as an example.

As shown in FIG. 3, the stabilization control calculation unit 60*a* includes multiple functional blocks: a speed estimation unit 60*b*, a sudden stoppage behavior prediction unit 60*c*, a stability judgment unit 60*d*, and an operation limitation determination unit 60*h*. The speed estimation unit 60*b* estimates the operation speed of each drive actuator from the result of the detection by the state quantity detection unit 30. The sudden stoppage behavior prediction unit 60*c* predicts the behavior of the work machine 1 till the complete stoppage of the work machine 1 on the assumption that a sudden stoppage operation will be performed. The stability judgment unit 60*d* judges the stability by calculating a ZMP trajectory in a sudden stoppage process based on the result of the prediction by the sudden stoppage behavior prediction unit 60*c*. The operation limitation determination unit 60*h* judges whether the operation limitation is necessary or not based on the result of the judgment by the stability judgment unit 60*d* and outputs the gradual stoppage command and the operation speed limitation command.

Stability Evaluation Based on ZMP

Before explaining the details of the functional blocks of the stabilization control calculation unit 60*a*, an explanation will be given of the ZMP which is used in this embodiment for the stability evaluation of the work machine 1 and a stability judgment method using the ZMP (ZMP stability discrimination criteria). The concept of the ZMP and the ZMP stability discrimination criteria have been elaborated on in Miomir Vukobratovic "LEGGED LOCOMOTION ROBOTS" (HOKOU ROBOTTO TO JINKOU NO ASHI (LEGGED LOCOMOTION ROBOTS AND ARTIFICIAL LEGS): translated into Japanese by Ichiro kato, THE NIKKAN KOGYO SHIMBUN, LTD.).

The ZMP means a point on the road surface where moments acting on the object become zero. Gravitational force, inertial force, external force and their moments act on the ground surface 29 from the work machine 1. According to the d'Alembert's principle, these amounts are in equilibrium with floor reaction force and floor reaction moment acting as the reaction from the ground surface 29 to the work machine 1. Thus, when the work machine 1 is stably in contact with the ground surface 29, a point where the moments in the pitch axis and roll axis directions are zero exists on or on the inside of a side of a support polygon formed by connecting the grounding points between the work machine 1 and the ground surface 29 avoiding concavity. This point is called the ZMP. Put another way, if the ZMP exists in the support polygon and the force acting on the ground surface 29 from the work machine 1 is in a direction for pushing the ground surface 29, the work machine 1 can be considered to be stably in contact with the ground surface 29.

The stability becomes higher as the ZMP gets closer to the center of the support polygon. When the ZMP exists inside the support polygon, the work machine 1 remains in the stable state and can carry out the work without overturning. In contrast, when the ZMP exists on a side of the support polygon, the work machine 1 starts overturning. Therefore, the stability can be judged by comparing the ZMP with the support polygon formed by the work machine 1 and the ground surface 29.

The ZMP is calculated by using the following equation (1) derived from the equilibrium of the moments caused by the gravitational force, inertial force and external force:

equation 1

$$\sum_i m_i(r_i - r_{zmp}) \times r_i'' - \sum_j M_j - \sum_k (s_k - r_{zmp}) \times F_k = 0 \quad (1)$$

Definitions of variables in the equation (1) are as follows:

$r_{zmp}$: ZMP position vector $m_i$: mass of the i-th mass point $r_i$: position vector of the i-th mass point $r''_i$: acceleration vector (including gravity acceleration) applied to the i-th mass point $M_j$: the j-th external force moment $s_k$: the k-th external force working point position vector $F_k$: the k-th external force vector Each vector is a three-dimensional vector composed of an X component, a Y component, and a Z component.

The ZMP when the work machine 1 is in the stationary state and only the gravitational force works on the work machine 1 coincides with the point of projection of the center of gravity (mass center) of the work machine 1 onto the ground surface 29. Therefore, the ZMP can be handled as a projection point of the center of gravity onto the ground surface 29 that has taken both the dynamic state and the static state into consideration. By using the ZMP as an index, cases where the work machine 1 is stationary and cases where the work machine 1 is performing an operation can be handled in an integrated manner.

Speed Estimation Unit

The speed estimation unit 60*b* estimates the operation speed of each drive actuator caused by the present lever operation based on the result of the detection by the state quantity detection unit 30. In general, the operation speed of each drive actuator of the work machine 1 changes approximately in proportion to the operation amount of the corresponding control lever 50, that is, approximately in proportion to the lever operation pilot pressure, although the operation speed can vary depending on the working conditions and the load conditions. The operation speed in the near future can be predicted by using information on the lever operation since a delay due to the hydraulic pressure and the mechanism exists between the operation on the control lever 50 and the operation speed. Thus, the speed estimation unit 60*b* predicts the operation speed in the near future by using a past lever operation pilot pressure, the present lever operation pilot pressure and the present operation speed.

Specifically, the speed estimation unit 60*b* first identifies a speed calculation model based on the past lever operation pilot pressure and the present operation speed. Subsequently, the speed estimation unit 60*b* predicts the operation speed in the near future by inputting the present lever operation pilot pressure to the identified speed calculation model. While the speed calculation model can be expected to change from moment to moment depending on factors such as the engine revolution speed, the magnitude of the load, the attitude and the fluid temperature, the change in the model may be considered to be small since the change in the working conditions is small in a short time interval. As a simpler method for implementing the speed estimation unit 60*b*, there is a method using a dead time $T_L$ from the time when the control lever 50 is operated to the time when the drive actuator starts moving and the proportionality coefficient $\alpha_v$ between the lever operation pilot pressure and the operation speed. Here, the dead time $T_L$ is determined previously on the assumption that it does not change. The speed after $T_L$ seconds is calculated according to the following procedure:

Step 1

The proportionality coefficient $\alpha_v$ is calculated from the lever operation pilot pressure $P_{lev}(t-T_L)$ at a time $T_L$ seconds earlier and the present speed V(t) by using the following equation (2):

equation 2

$$\alpha_v = v(t)/P_{lev}(t-t_L) \tag{2}$$

Step 2

The estimate value $v(t+T_L)$ of the speed after $T_L$ seconds is calculated from the obtained proportionality coefficient $\alpha_v$ and the present lever operation pilot pressure $P_{lev}(t)$ by using the following equation (3):

equation 3

$$v(t+t_L) = \alpha_v P_{lev}(t) \tag{3}$$

Sudden Stoppage Behavior Prediction Unit

The sudden stoppage behavior prediction unit 60*c* predicts the behavior of the work machine 1 at a time of a sudden stoppage command on the assumption that the sudden stoppage command will be issued. The sudden stoppage behavior prediction unit 60*c* calculates a position trajectory, a speed trajectory and an acceleration trajectory from the issuance of the sudden stoppage command to the complete stoppage of the drive actuator based on the present attitude information, the speed estimation result by the speed estimation unit 60*b*, and a sudden stoppage model. The sudden stoppage model can be obtained by, for example, modeling the speed trajectory at the time of the sudden stoppage and then calculating the position trajectory and the acceleration trajectory from the speed trajectory. When the speed trajectory at the time of the sudden stoppage command is previously modeled and the cylinder speed at a time that is $t_e$ seconds after the time t of the issuance of the sudden stoppage command (control lever release time) is given as $V_{stop}(t, t_e)$, the cylinder length $l_{stop}(t, t_e)$ and the cylinder acceleration $a_{stop}(t, t_e)$ after $t_e$ seconds can be calculated by using the cylinder length $l_{stop}(t, 0)$ at the time of the start of the sudden stoppage according to the following equations (4):

equation 4

$$l_{stop}(t, t_e) = l_{stop}(t, 0) + \int_0^{t_e} v_{stop}(t, u)du \tag{4}$$

$$a_{stop}(t, t_e) = \frac{v_{stop}(t, u)}{du}\Big|_{u=t_e}$$

To make the sudden stoppage behavior prediction in real time, it is desirable to model the speed trajectory at the time of the sudden stoppage by using a simple model. A first-order lag system, a multiple-order lag system, and a polynomial function can be considered as the simple model for the speed trajectory at the time of the sudden stoppage. The gradual stoppage is performed in the stabilization control in this embodiment. Therefore, in addition to the modeling of the behavior at the time of the sudden stoppage command, similar modeling is conducted also for the behavior at the time of the gradual stoppage command.

The stability judgment unit 60*d* judges the stability by calculating the ZMP trajectory in the sudden stoppage process by using the trajectories at the time of the sudden stoppage calculated by the sudden stoppage behavior prediction unit 60*c*.

Specifically, the stability judgment unit 60*d* first calculates a position vector trajectory and an acceleration vector trajectory of the center of gravity of each principal component of the work machine 1 by using the result of the prediction by the sudden stoppage behavior prediction unit 60*c*. Then, the stability judgment unit 60*d* calculates the ZMP trajectory by using the following equations (5) and (6) derived from the equation (1):

equation 5

$$r_{zmpx} = \frac{\sum_i m_i(r_{ix}r''_{iz} - r_{iz}r''_{ix}) - \sum_k (s_{kx}F_{kz} - s_{kz}F_{kx})}{\sum_i m_i r''_{iz} - \sum_k F_{kz}} \quad (5)$$

equation 6

$$r_{zmpy} = \frac{\sum_i m_i(r_{iy}r''_{iz} - r_{iz}r''_{iy}) - \sum_k (s_{ky}F_{kz} - s_{kz}F_{ky})}{\sum_i m_i r''_{iz} - \sum_k F_{kz}} \quad (6)$$

The ZMP trajectory at the time of the sudden stoppage can be calculated by substituting the position vector trajectory and the acceleration vector trajectory of the center of gravity of each principal component at the time of the sudden stoppage into the aforementioned variables r and r", respectively.

Figure 6:
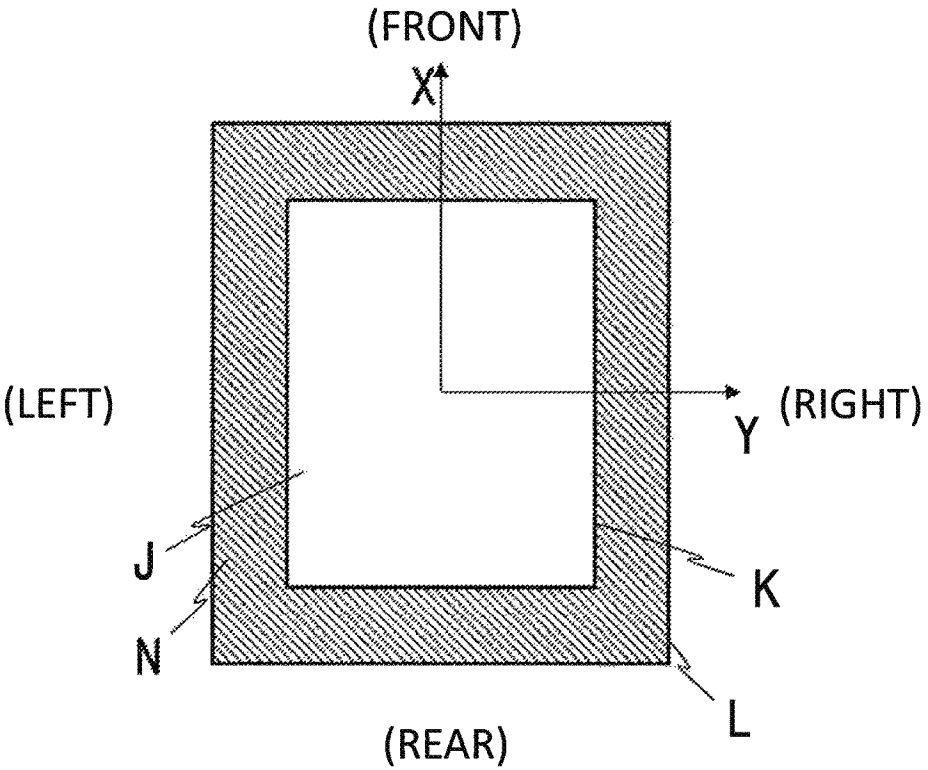
FIG. 6 is an explanatory drawing of a stability evaluation method according to the first embodiment.

Subsequently, the stability judgment unit 60*d* judges the stability at the time of the sudden stoppage by using the calculated ZMP trajectory at the time of the sudden stoppage. As mentioned above, when the ZMP exists in a region sufficiently inside the support polygon L formed by the work machine 1 and the ground surface 29, the work can be performed in a stable manner with almost no possibility of the work machine 1 becoming unstable. When the track structure 2 is positioned upright with respect to the ground surface 29, the support polygon L is identical with the planar shape of the track structure 2. Thus, in cases where the track structure 2 has a rectangular planar shape, the support polygon L is also a rectangle as shown in FIG. 6. More specifically, in the case where the work machine 1 has crawlers as components of the track structure 2, the support polygon L is a quadrangle having a front boundary line connecting the centers of the left and right sprockets, a rear boundary line connecting the centers of the left and right idlers, a left boundary line as the outer edge of the left track link, and a right boundary line as the outer edge of the right track link. The front and rear boundaries may also be defined by using the foremost lower rollers and the rearmost lower rollers as the grounding points.

The stability judgment unit 60*d* divides the support polygon L into a normal region J in which the possibility of the work machine 1 becoming unstable is sufficiently low and a stability warning region N in which the possibility of the work machine 1 becoming unstable is high, and makes the stability judgment by judging in which region the ZMP exists. Normally, the boundary K between the normal region J and the stability warning region N is set as a polygon formed by contracting the support polygon L toward its center by a ratio determined based on a safety factor, or a polygon formed by shifting the support polygon L inward by a distance determined based on a safety factor. The stability judgment unit 60*d* outputs the stability judgment result as "stable" if all points on the ZMP trajectory at the time of the sudden stoppage are inside the normal region J. In contrast, if the ZMP trajectory at the time of the sudden stoppage enters the stability warning region N, that is, if the ZMP enters the stability warning region N at a certain time point in the sudden stoppage process, the stability judgment unit 60*d* outputs the stability judgment result as "unstable."

Operation Limitation Determination Unit

The operation limitation determination unit 60*h* judges whether the operation limitation is necessary or not based on the result of the judgment by the stability judgment unit 60*d* and calculates operation limitation commands. The stabilization control system 190 in this embodiment performs the gradual stoppage and the operation speed limitation in order to keep the work machine 1 stable. Therefore, the operation limitation determination unit 60*h* calculates the gradual stoppage command and the operation speed limitation command as the operation limitation commands and outputs these commands to the command value generation unit 60*i*.

As mentioned above, the stabilization control calculation unit 60*a* in this embodiment calculates the operation limitation necessary for the stabilization by repeating the behavior prediction and the stability evaluation multiple times as needed. A method for judging the necessity of the operation limitation and the repetitive operation will be explained below with reference to FIG. 7.

Figure 7:
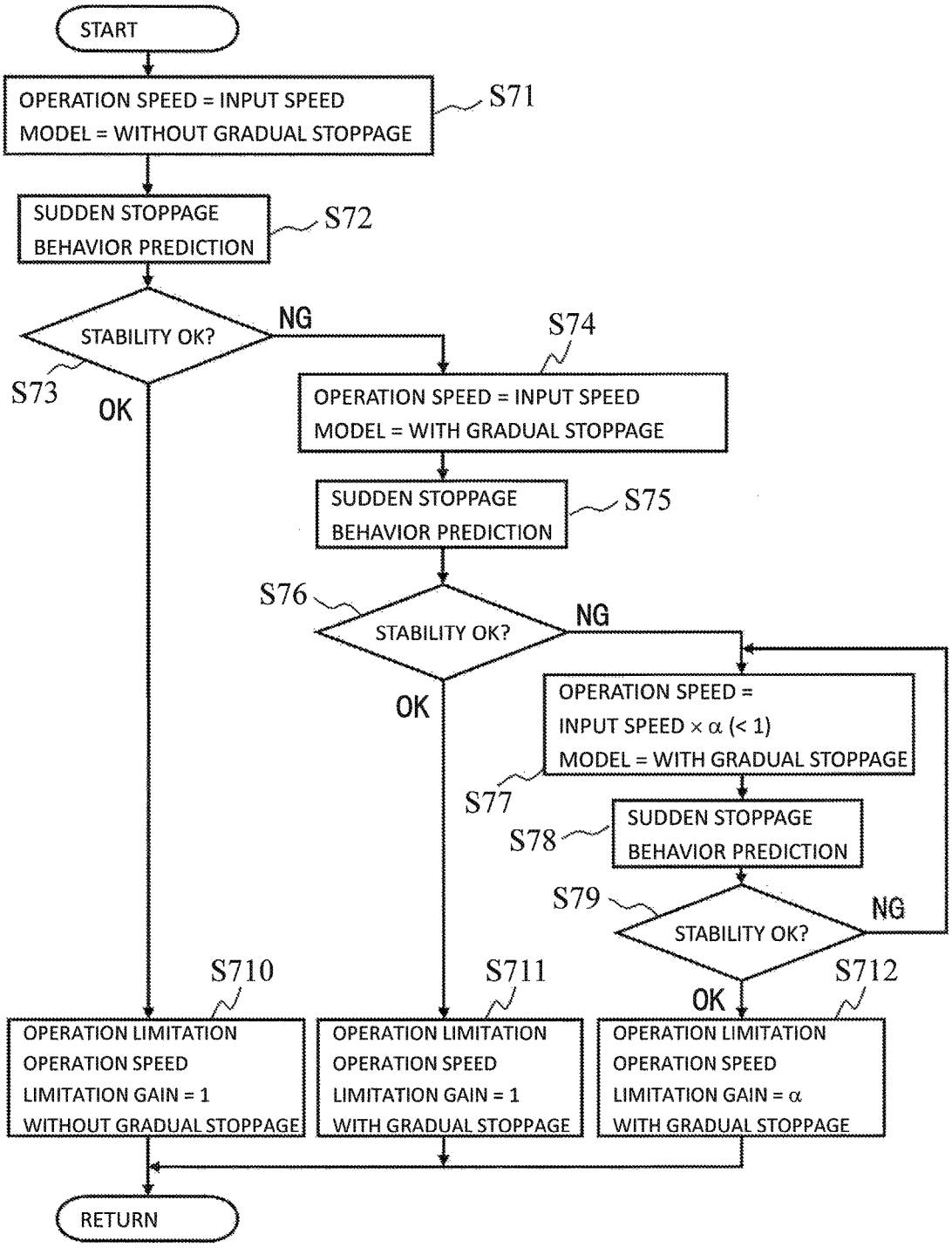
FIG. 7 is a flow chart showing the procedure of calculation performed by an operation limitation determination unit in the first embodiment.

Referring to FIG. 7, in the first trial, the setting is made to use the result of the estimation by the speed estimation unit 60*b* and the sudden stoppage model (step S71), and the behavior prediction (step S72) and the stability judgment (step S73) are made.

If the result of the judgment in the step S73 is "stable," the operation limitation is not performed (OK in the step S73). In this case, a command specifying "without gradual stoppage" and "operation speed limitation gain=1" is outputted (step S710).

In contrast, if the result of the judgment by the stability judgment unit 60*d* is "unstable" (NG in the step S73), the setting is made to use a gradual stoppage model instead of the sudden stoppage model (step S74), and the behavior prediction (step S75) and the stability judgment (step S76) after the setting change are made.

If the result of the judgment by the stability judgment unit 60*d* in the step S76 is "stable" (OK in the step S76), the operation limitation command is issued so as to set the operation speed limitation gain at 1 and perform only the gradual stoppage (step S711).

In contrast, if the result of the judgment by the stability judgment unit 60*d* is "unstable" (NG in the step S76), the setting is made to use the product of the speed estimate value and the operation speed limitation gain $\alpha$ (<1) and the gradual stoppage model (step S77), and the behavior prediction (step S78) and the stability judgment (step S79) after the setting change are made.

If the result of the judgment by the stability judgment unit 60*d* is "stable" (OK in the step S79), the operation limitation command is issued so as to perform the gradual stoppage and the operation speed limitation at the operation speed limitation gain $\alpha$ (step S712).

In contrast, if the result of the judgment by the stability judgment unit 60*d* is "unstable" (NG in the step S79), the operation speed limitation gain $\alpha$ is gradually decreased and the behavior prediction (step S78) and the stability judgment (step S79) are repeated until the judgment by the stability judgment unit 60*d* turns into "stable."

Incidentally, while the above explanation has been given by taking an example of a case where only one stoppage characteristic is selectable at the time of the gradual stoppage command, it is also possible to configure the system to set a plurality of stoppage characteristics and change the degree of the gradual stoppage depending on the status of stability. Indices representing the degree of the gradual stoppage can include, for example, the time necessary for the stoppage (stoppage time), the distance necessary for the stoppage (braking distance), the deceleration, the drop in the pilot pressure per unit time (pilot pressure change rate), etc. When multiple settings are made, a stoppage characteristic that should be satisfied is determined in each setting. The operation limitation determination unit 60*h* calculates the operation limitation so as to start limiting the operation speed when the stability judgment result has become "unstable" in every gradual stoppage setting.

Command Value Generation Unit

The command value generation unit 60*i* generates drive command values for the pilot pressure correction unit 200 based on the gradual stoppage command and the operation speed limitation command outputted from the stabilization control calculation unit 60*a* and outputs the drive command values to the output unit 60*y* of the calculation device 60.

Specifically, the command value generation unit 60*i* calculates drive command values for the stoppage characteristic modification unit 210 from the gradual stoppage command value and calculates drive command values for the operation speed limitation unit 240 from the operation speed limitation gain. In the stabilization control system 190 in this embodiment, each of the pilot hydraulic lines for boom expansion, boom contraction, arm expansion and arm contraction is equipped with its respective stoppage characteristic modification unit 211, 212, 213, 214 and its respective operation speed limitation unit 241, 242, 243, 244 as shown in FIG. 5A, and the command value generation unit 60*i* calculates a drive command value for each stoppage characteristic modification unit 211, 212, 213, 214 and each operation speed limitation unit 241, 242, 243, 244. In the following, the method for calculating the drive command values for the boom expansion stoppage characteristic modification unit 211 and the boom expansion operation speed limitation unit 241 will be explained by taking the correction of the boom expansion pilot hydraulic fluid as an example. First, the explanation will be given of the method for calculating the drive command value for the boom expansion stoppage characteristic modification unit 211.

As explained referring to FIG. 5B, the stoppage characteristic modification unit 211 in this embodiment includes the gradual stoppage solenoid proportional valve 221 and the gradual stoppage high pressure selection unit 231. When a rapid deceleration operation or a stoppage operation is performed by the operator, the stoppage characteristic modification unit 211 makes the corresponding drive actuator stop gradually by driving the gradual stoppage solenoid proportional valve 221 so as to generate pilot hydraulic fluid satisfying the gradual stoppage command outputted from the operation limitation determination unit 60*h*. Similarly, the stoppage characteristic modification unit 212 includes a gradual stoppage solenoid proportional valve 222 and a gradual stoppage high pressure selection unit 232, and the operation speed limitation unit 242 includes a speed limitation solenoid proportional valve 252. The gradual stoppage solenoid proportional valve 222 and the speed limitation solenoid proportional valve 252 are driven by command signals outputted from the calculation device 60 which will be explained later.

While various calculation methods for the drive commands for performing the gradual stoppage can be considered depending on the method of setting the stoppage characteristic at the time of the gradual stoppage, the following explanation will be given by taking an example of a case where the rate of change of the pressure of the pilot hydraulic fluid supplied to the boom flow control valve 111 is commanded as the stoppage characteristic and the lever operation pilot pressure is corrected by using the correction curve shown in FIG. 4A.

As mentioned above, the pressure of the pilot hydraulic fluid supplied to the boom flow control valve 111 and the operation speed of the drive actuator are in a proportional relationship. Therefore, the drive actuator decelerates more quickly than the commanded stoppage characteristic when the rate of change of the lever operation pilot pressure at the time of the deceleration/stoppage operation is higher than the command value, and decelerates more gradually than the commanded stoppage characteristic when the rate of change of the lever operation pilot pressure at the time of the deceleration/stoppage operation is lower than the command value. The case where the stabilization control system 190 in this embodiment has to perform the operation limitation is the case where the drive actuator stops faster than the commanded stoppage characteristic.

Therefore, the command value generation unit 60*i* first compares the rate of change of the lever operation pilot pressure with a change rate command value, that is, a command value regarding the rate of change. If the rate of change of the lever operation pilot pressure is higher than the change rate command value, the pilot pressure is corrected by using the correction curve shown in FIG. 4A to monotonically decrease satisfying the change rate command value. Specifically, the pressure of the pilot hydraulic fluid outputted from the stoppage characteristic modification unit 211 is set as shown in the following equation (7):

equation 7

$$P_{211}(t) = \begin{cases} P_{lev}(t) & (\text{when } P_{lev}(t) - P_{lev}(t-\Delta t) < k\Delta t) \\ P_{lev}(t-\Delta t) - k\Delta t & (\text{when } P_{lev}(t) - P_{lev}(t-\Delta t) \geq k\Delta t) \end{cases} \quad (7)$$

Here, $P_{lev}(t)$ represents the lever operation pilot pressure at the time t, $P_{211}(t)$ represents the pressure of the pilot hydraulic fluid outputted from the stoppage characteristic modification unit 211 at the time t, and k represents the pilot pressure change rate command value. When the stoppage characteristic modification unit 211 outputs the lever operation pilot pressure without making any correction, there is no need of driving the gradual stoppage solenoid proportional valve 221. It is sufficient if the gradual stoppage solenoid proportional valve 221 is driven to generate the gradual stoppage pilot hydraulic fluid at the pressure calculated according to the equation (7) only when the rate of change of the lever operation pilot pressure is higher than the change rate command value. Thus, the command pressure of the gradual stoppage solenoid proportional valve 221 is calculated according to the following equation (8):

equation 8

$$P_{221c}(t) = \begin{cases} 0 & (\text{when } P_{lev}(t) - P_{lev}(t-\Delta t) < k\Delta t) \\ P_{lev}(t-\Delta t) - k\Delta t & (\text{when } P_{lev}(t) - P_{lev}(t-\Delta t) \geq k\Delta t) \end{cases} \quad (8)$$

Here, $P_{221c}(t)$ represents the command pressure of the gradual stoppage solenoid proportional valve 221 at the time t.

Figure 8A:
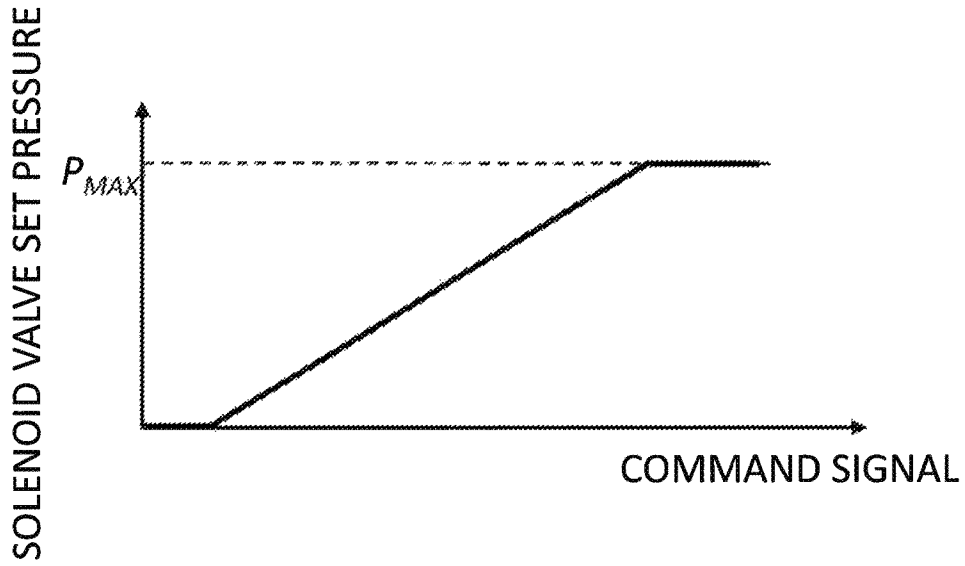
FIG. 8A is a diagram showing an example of the relationship between set pressure of a solenoid valve and a command signal included in a drive command to the pilot pressure correction unit in the first embodiment.
Figure 8B:
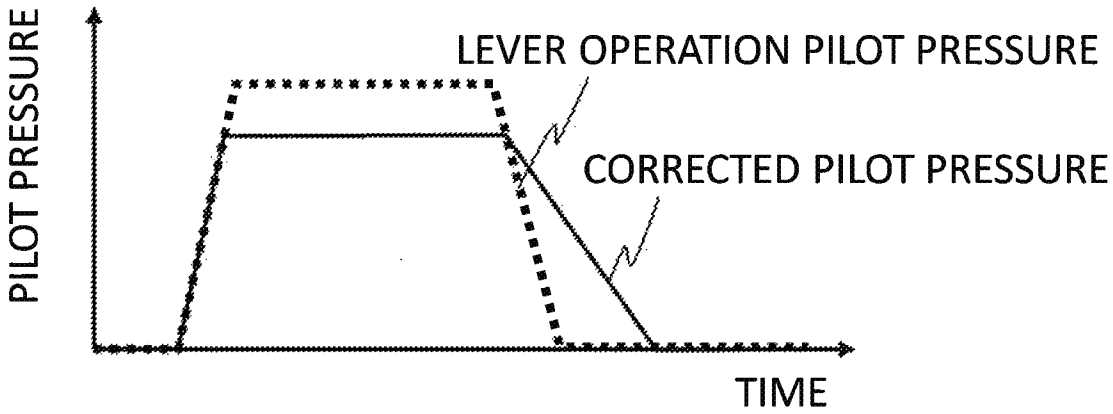
FIG. 8B is a diagram showing an example of pilot pressure correction made by the pilot pressure correction unit in the first embodiment for performing the gradual stoppage and the operation speed limitation.
Figure 8C:
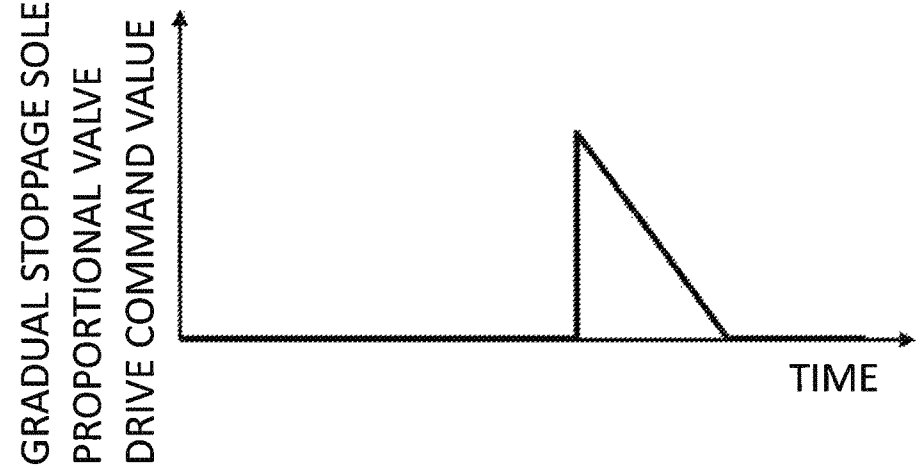
FIG. 8C is a diagram showing an example of the relationship between the time and a drive command value for a gradual stoppage solenoid proportional valve in the first embodiment.

The pressure of the hydraulic fluid outputted from the gradual stoppage solenoid proportional valve 221 is determined by the magnitude of the command signal, and the relationship between the command signal and the pressure is given as the output characteristic of the valve as shown in FIG. 8A, for example. The drive command value for the gradual stoppage solenoid proportional valve 221 is determined by using the command pressure calculated according to the equation (8) and the output characteristic of the gradual stoppage solenoid proportional valve 221. For example, the drive command value for the gradual stoppage solenoid proportional valve 221 when the correction shown in FIG. 88B is made is calculated as shown in FIG. 8C.

Since the stabilization control system 190 in this embodiment performs the operation limitation on the boom cylinder 11 and the arm cylinder 13, the stabilization control system 190 is equipped with four gradual stoppage solenoid proportional valves: the boom expansion gradual stoppage solenoid proportional valve 221, the boom contraction gradual stoppage solenoid proportional valve 222, an arm expansion gradual stoppage solenoid proportional valve, and an arm contraction gradual stoppage solenoid proportional valve. The command value generation unit 60*i* calculates the drive command value for each gradual stoppage solenoid proportional valve by using the lever operation pilot pressure corresponding to the gradual stoppage solenoid proportional valve.

Next, the method for calculating the drive command value for the boom expansion operation speed limitation unit 241 will be explained below. As mentioned above, the speed limitation solenoid proportional valve 251 is employed as the operation speed limitation unit 241 in this embodiment and the upper limit pressure of the pilot hydraulic fluid supplied to the pilot port of the boom flow control valve 111 is determined by the drive command value for the speed limitation solenoid proportional valve 251. Since the operation speed of the drive actuator is approximately in proportion to the pilot pressure, the drive command value for the speed limitation solenoid proportional valve 251 may be calculated based on the operation speed limitation gain outputted from the operation limitation determination unit 60*h*.

Specifically, when the maximum drive command is given to the speed limitation solenoid proportional valve 251, the pilot hydraulic fluid inputted to the speed limitation solenoid proportional valve 251 from the stoppage characteristic modification unit 211 is outputted with no correction irrespective of the pressure of the inputted pilot hydraulic fluid. Therefore, when the operation speed limitation gain is 1, the maximum drive command is given to the speed limitation solenoid proportional valve 251.

In contrast, when the operation speed limitation gain is less than 1, the lever operation pilot pressure has to be reduced, and thus the drive command is issued so as to reduce the lever operation pilot pressure according to the operation speed limitation gain. Here, the operation speed limitation gain represents the necessary ratio of deceleration from the operation speed commanded by the lever operation. The operation speed limitation gain can be regarded as the ratio of pressure reduction that has to be performed on the lever operation pilot pressure. Therefore, it is desirable to drive the speed limitation solenoid proportional valve 251 so as to keep the pressure of the corrected pilot hydraulic fluid outputted from the speed limitation solenoid proportional valve 251 within the product of the lever operation pilot pressure and the operation speed limitation gain. Thus, the command pressure of the speed limitation solenoid proportional valve 251 is calculated as follows:

equation 9

$$P_{251c}(t) = \begin{cases} P_{MAX} & (\text{when } \alpha = 1) \\ \alpha P_{lev}(t) & (\text{when } \alpha < 1) \end{cases} \quad (9)$$

Here, $P_{251c}(t)$ represents the command pressure of the speed limitation solenoid proportional valve 251 at the time t, and $P_{MAX}$ represents the rated pressure of the speed limitation solenoid proportional valve 251.

Figure 8D:
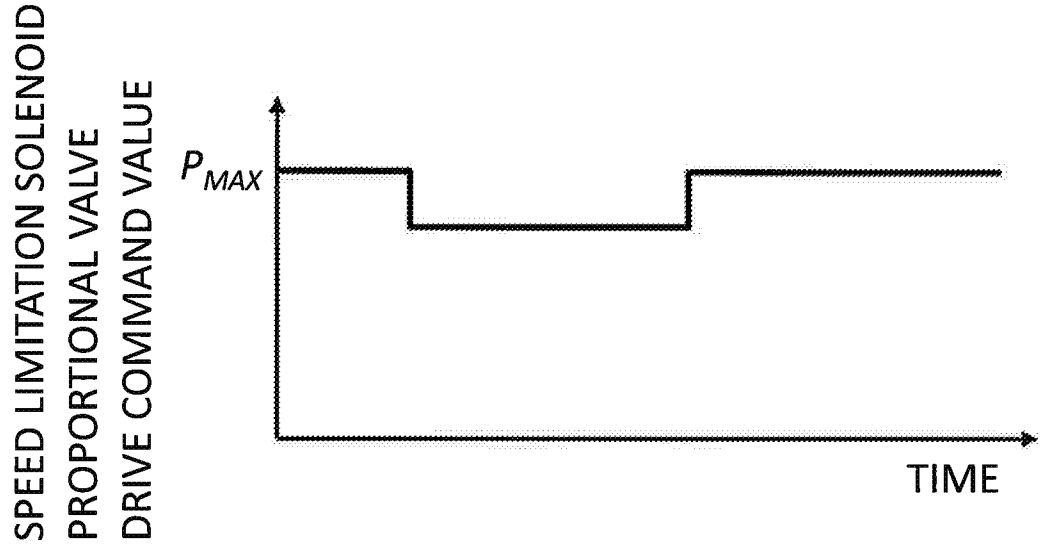
FIG. 8D is a diagram showing an example of the relationship between the time and a drive command value for a speed limitation solenoid proportional valve in the first embodiment.

Similarly to the case of the gradual stoppage solenoid proportional valve 221, the pressure of the hydraulic fluid outputted from the speed limitation solenoid proportional valve 251 is determined by the magnitude of the command signal, and the relationship between the command signal and the pressure is given as the output characteristic of the valve as shown in FIG. 8A, for example. The drive command value for the speed limitation solenoid proportional valve 251 is determined by using the command pressure calculated according to the equation (9) and the output characteristic of the speed limitation solenoid proportional valve 251. For example, the drive command value for the speed limitation solenoid proportional valve 251 when the correction shown in FIG. 8B is made is calculated as shown in FIG. 8D.

Since the stabilization control system 190 in this embodiment performs the operation limitation on the boom cylinder 11 and the arm cylinder 13, the stabilization control system 190 is equipped with four speed limitation solenoid proportional valves: the boom expansion speed limitation solenoid proportional valve 251, the boom contraction speed limitation solenoid proportional valve 252, an arm expansion speed limitation solenoid proportional valve (unshown), and an arm contraction speed limitation solenoid proportional valve (unshown). The command value generation unit 60*i* calculates the drive command value for each solenoid proportional valve. The drive command value is calculated from the corresponding lever operation pilot pressure by using the equation (9). By calculating the drive command based on the lever operation pilot pressure as above, the operation speed limitation commanded by the stabilization control calculation unit 60*a* can be implemented consistently by use of the speed limitation solenoid proportional valve 251 even when the relationship between the pilot pressure and the operation speed changes depending on the working conditions.

Function

As described above, according to this embodiment, even when the operator performs a forceful or erroneous operation on the work machine 1, the operation limitation necessary for keeping the work machine 1 stable is performed and the work can be continued without impairing the stability. Further, this embodiment is configured to make the correction by the pilot pressure correction unit 200 only when the operation limitation is necessary and to drive the drive actuator by using the pilot hydraulic fluid outputted from the proportional pressure reducing valve set similarly to the conventional technology when the operation limitation is unnecessary. Thus, the operation limitation can be performed without impairing the conventional operability. Accordingly, a work machine of excellent operability and stability can be provided by use of the stabilization control system 190 in this embodiment.

Modification of First Embodiment

Sensor Configuration

While the attitude sensor 3*b* for detecting the inclination of the work machine 1 is provided as an example of the attitude detection unit 49 in the above embodiment, it is also possible to assume the inclination of the work machine 1 as a constant value and provide no attitude sensor 3*b* in cases where the inclination of the work machine 1 never changes during work.

Further, while the boom expansion operation amount sensor 51, the boom contraction operation amount sensor 52, the arm expansion operation amount sensor 53, the arm contraction operation amount sensor 54, the attachment expansion operation amount sensor 55, the attachment contraction operation amount sensor 56, the right swing operation amount sensor 57 and the left swing operation amount sensor 58 are provided as the lever operation amount detection unit 50*a* in the example described in the above embodiment, it is also possible to provide sensors only in regard to lever operations on drive actuators to which the operation limitation is applied. For example, in cases where the operation limitation is performed exclusively on the boom cylinder 11 and the arm cylinder 13, it is possible to leave out the attachment expansion operation amount sensor 55, the attachment contraction operation amount sensor 56, the right swing operation amount sensor 57, and the left swing operation amount sensor 58.

Drive Actuators as Objects of Operation Limitation

While the above embodiment has been described by taking an example of a case where the operation limitation is performed on the boom cylinder 11 and the arm cylinder 13, the system may also be configured to perform the operation limitation on the swing motor 7 and the attachment cylinder 15 in addition to the boom cylinder 11 and the arm cylinder 13.

In this case, not only each of the pilot hydraulic lines for boom expansion, boom contraction, arm expansion and arm contraction but also each of the pilot hydraulic lines for right swing, left swing, attachment expansion and attachment contraction may be equipped with its respective pilot pressure correction unit, and the command value generation unit 60*i* may be configured to generate the drive commands not only for the pilot pressure correction units 201, 202, 203 and 204 for boom expansion, boom contraction, arm expansion and arm contraction but also for the pilot pressure correction units for right swing, left swing, attachment expansion and attachment contraction.

Modification of Operation Speed Limitation Unit

A modification of the pilot pressure correction unit will be described below by taking the correction of the boom expansion pilot hydraulic fluid as an example.

While the speed limitation solenoid proportional valve 251 having the normally closed characteristic is used as the boom expansion operation speed limitation unit 241 in the example described in the above embodiment, the speed limitation solenoid proportional valve 251 does not necessarily has to have the aforementioned characteristic since the speed limitation solenoid proportional valve 251 has only to have the function of reducing the pressure of the pilot hydraulic fluid supplied to the boom expansion side pilot port 111*e* of the boom flow control valve 111 to the command pressure. For example, a solenoid proportional valve shown in FIG. 9A, having the normally open characteristic, can be employed as another example of the speed limitation solenoid proportional valve 251.

Figure 9A:
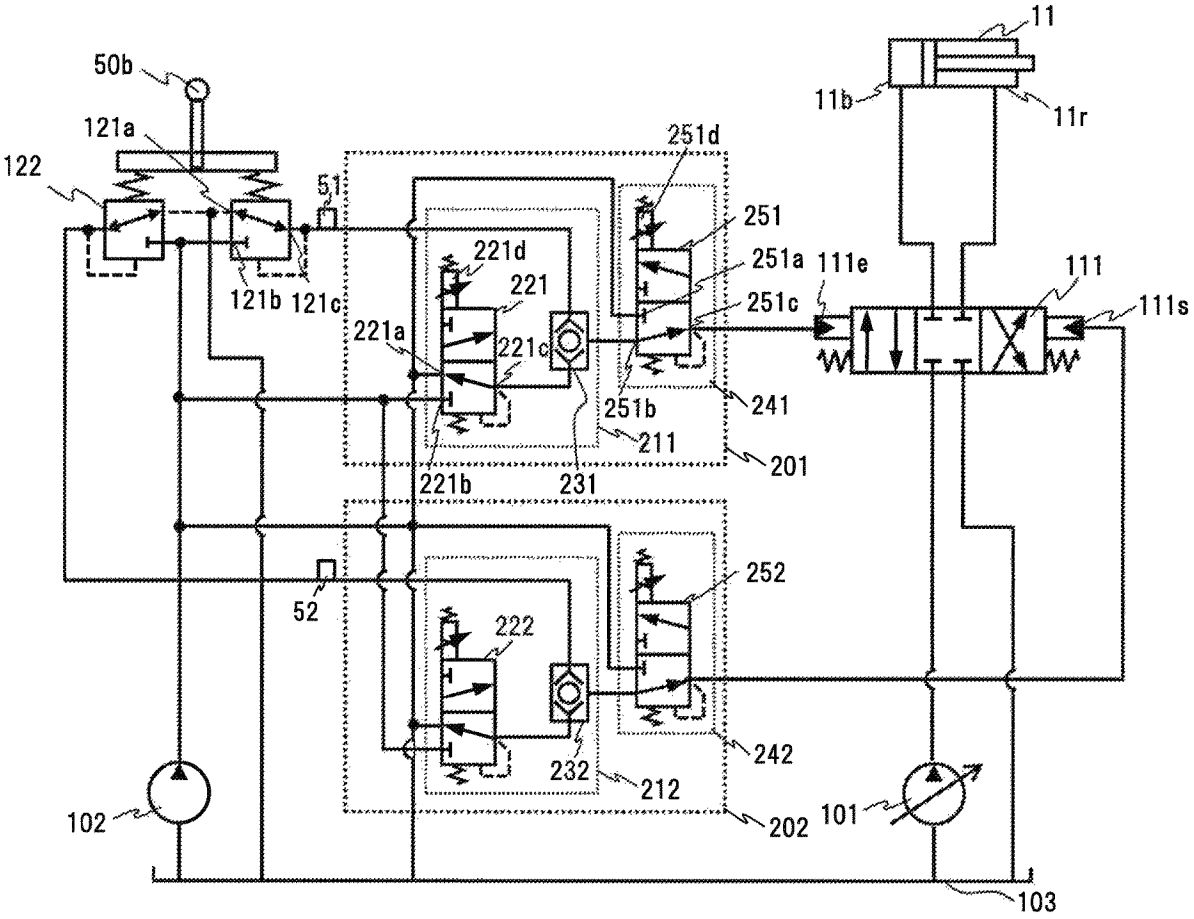
FIG. 9A is a schematic configuration diagram of a modification of the pilot pressure correction unit according to the first embodiment.

Specifically, the speed limitation solenoid proportional valve 251 is configured as a solenoid proportional valve of the normally open type as shown in FIG. 9A. In this case, when the solenoid 251*d* is not excited, a valve passage for the communication between the second port 251*b* and the third port 251*c* is fully open, the first port 251*a* is fully closed, and the pilot hydraulic fluid from the stoppage characteristic modification unit 211 is supplied to the boom expansion side pilot port 111*e* of the boom flow control valve 111 without being decompressed. In contrast, when the solenoid 251*d* is excited by a command signal from the calculation device 60, the speed limitation solenoid proportional valve 251 is driven in a direction for closing the valve passage for the communication between the second port 251*b* and the third port 251*c* and the pilot hydraulic fluid from the stoppage characteristic modification unit 211 is decompressed to the command pressure. When the command signal to the solenoid 251*d* is at the maximum, a valve passage for the communication between the first port 251*a* and the third port 251*c* is fully open and the second port 251*b* is fully closed. In this case, the supply of the pilot hydraulic fluid to the boom flow control valve 111 is stopped and the hydraulic fluid in the pilot hydraulic line connected to the pilot port of the boom flow control valve 111 is discharged to the hydraulic fluid tank 103.

In cases where a solenoid proportional valve having the above-described characteristic is used, the command value generation unit 60*i* issues the drive command so as to set the solenoid 251*d* in the unexcited state when the operation speed limitation gain outputted from the operation limitation determination unit 60*h* is 1, and to set the command pressure of the speed limitation solenoid proportional valve 251 at the pressure calculated according to the equation (9) when the operation speed limitation gain is less than 1.

Characteristics of the use of the normally closed solenoid proportional valve as the speed limitation solenoid proportional valve 251 and the use of the normally open solenoid proportional valve as the speed limitation solenoid proportional valve 251 will be explained below.

In the case of using the speed limitation solenoid proportional valve 251 of the normally closed type shown in FIG. 5B, when a failure occurs in the calculation device 60 or in an electric circuit connecting the calculation device 60 and the speed limitation solenoid proportional valve 251 and the command signal is not given to the solenoid 251*d*, the solenoid 251*d* shifts to the unexcited state, the supply of the pilot hydraulic fluid to the boom flow control valve 111 stops, and the drive actuator shifts to the stopped state. In contrast, in the case of using the speed limitation solenoid proportional valve 251 of the normally open type, when the command signal is not given to the solenoid 251*d*, the pilot hydraulic fluid outputted from the stoppage characteristic modification unit 211 is supplied to the boom flow control valve 111, and thus the operation of the drive actuator continues with no limitation on its operation speed.

Further, in the case of using the speed limitation solenoid proportional valve 251 of the normally closed type, the calculation device 60 has to constantly output the maximum command signal when the correction by the operation speed limitation unit 241 is unnecessary, whereas the command signal may be set at zero in the case of using the normally open type. Thus, the necessary amount of electric current tends to be smaller in the case of using the normally open type.

Therefore, the normally closed type excels in terms of safety, while the normally open type excels in terms of convenience and the necessary amount of electric current. Which characteristic of solenoid proportional valve should be used may be determined in consideration of the safety, the convenience, and the calculation device performance required of the work machine for which the solenoid proportional valve is employed.

Figure 9B:
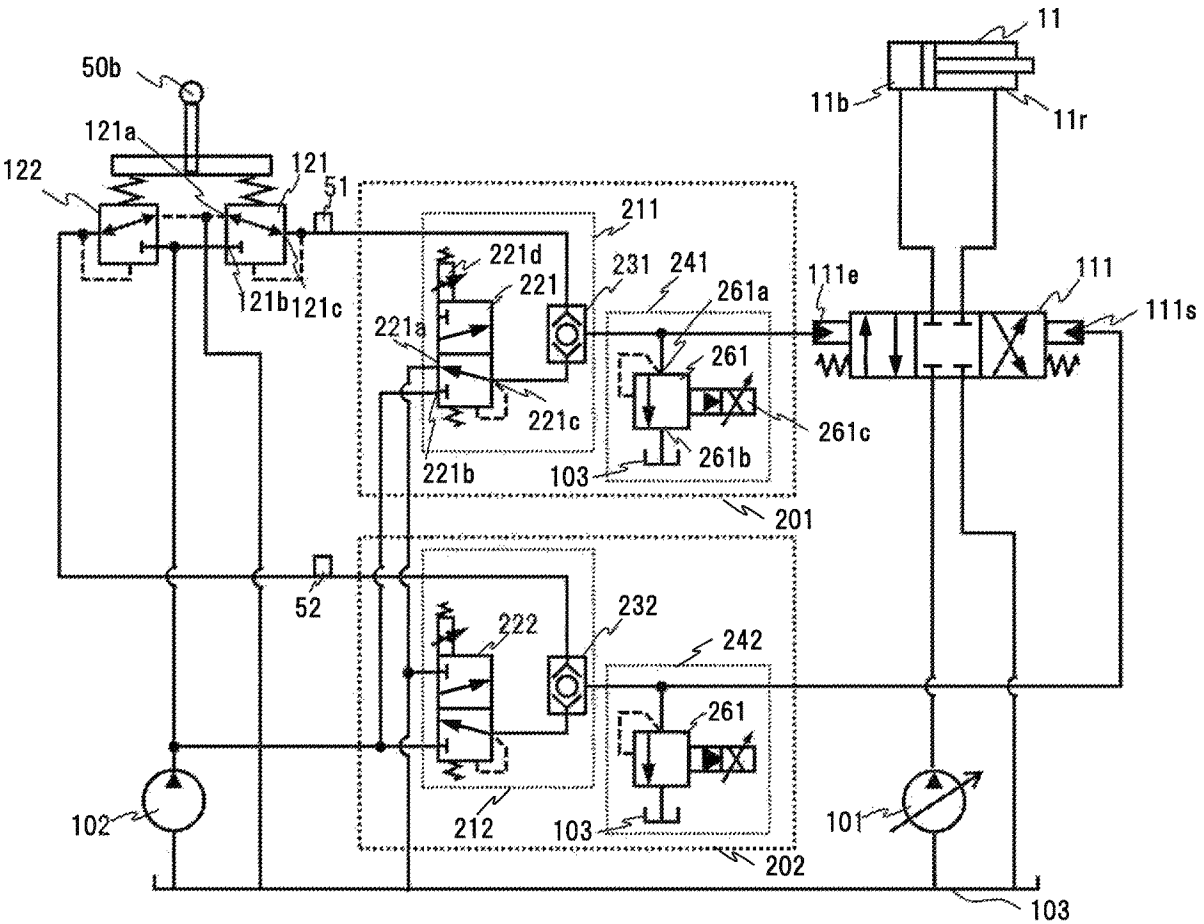
FIG. 9B is a schematic configuration diagram of another modification of the pilot pressure correction unit according to the first embodiment.

Furthermore, while the speed limitation solenoid proportional valve 251 is provided as the operation speed limitation unit 241 in the example described in the above embodiment, the operation speed limitation unit 241 has only to have the function of reducing the pressure of the pilot hydraulic fluid supplied to the boom flow control valve 111 to the command pressure, and thus configurations other than the solenoid proportional valve may also be used. A configuration including a speed limitation solenoid proportional relief valve 261 instead of the speed limitation solenoid proportional valve 251 can be considered as another configuration example. FIG. 9B shows the overall configuration of the pilot pressure correction unit 201 including the speed limitation solenoid proportional relief valve 261 as the operation speed limitation unit.

Specifically, the speed limitation solenoid proportional relief valve 261 has an input port 261*a*, a tank port 261*b*, and a solenoid 261*c* as shown in FIG. 9B. The input port 261*a* is connected to a pilot hydraulic line connecting the stoppage characteristic modification unit 211 to the boom expansion side pilot port 111*e* of the boom flow control valve 111, while the tank port 261*b* is connected to the hydraulic fluid tank 103. The solenoid 261*c* is excited by a command signal from the calculation device 60. The set pressure of the speed limitation solenoid proportional relief valve 261 is determined by the magnitude of the command signal.

In the speed limitation solenoid proportional relief valve 261, when the pressure on the input port 261*a* side is higher than the set pressure, a valve passage for the communication between the input port 261*a* and the tank port 261*b* opens and the hydraulic fluid in the hydraulic line connected to the input port 261*a* is discharged to the hydraulic fluid tank 103. Accordingly, the pressure on the input port 261*a* side, that is, the pressure of the pilot hydraulic fluid supplied from the stoppage characteristic modification unit 211 to the boom expansion side pilot port 111*e* of the boom flow control valve 111, is kept within the set pressure. When the valve passage for the communication between the input port 261*a* and the tank port 261*b* is fully closed, the pilot hydraulic fluid is not corrected by the speed limitation solenoid proportional relief valve 261. Therefore, by setting the set pressure of the speed limitation solenoid proportional relief valve 261 at the upper limit pressure satisfying the operation speed limitation commanded by the stabilization control calculation unit 60*a*, the operation speed limitation can be carried out similarly to the case of employing the speed limitation solenoid proportional valve 251.

In the case of employing the speed limitation solenoid proportional relief valve 261 as the operation speed limitation unit 241, the command value generation unit 60*i* may calculate the drive command value so that the set pressure hits the maximum when the operation speed limitation gain outputted from the operation limitation determination unit 60*h* is 1. When the operation speed limitation gain is less than 1, the command value generation unit 60*i* may calculate the drive command value so that the set pressure becomes equal to the command pressure calculated according to the equation (9).

Drive Command for Gradual Stoppage Solenoid Proportional Valve

In the above embodiment, the explanation has been given of an example in which the command-value generation unit 60*i* issues the drive command to the gradual stoppage solenoid proportional valve 221 only when the lever operation pilot pressure drops more sharply than the commanded stoppage characteristic. In the above example, the command signal is set at zero when the lever operation pilot pressure does not drop or drops more gradually than the commanded stoppage characteristic.

However, there is generally a certain delay between the time of issuance of the drive signal to the solenoid proportional valve and the time when the outputted hydraulic fluid reaches the command pressure. When the responsiveness of the gradual stoppage solenoid proportional valve 221 is low, there is a possibility that the pressure temporarily drops due to the time lag in the pressure rise to the command pressure and the gradual stoppage is not performed correctly. To avoid this problem, the system may be configured to constantly supply a standby signal to the gradual stoppage solenoid proportional valve 221. The magnitude of the standby signal in this case is set within an extent in which the gradual stoppage pilot pressure does not exceed the lever operation pilot pressure. The magnitude of the standby signal may be determined in consideration of the responsiveness of the gradual stoppage solenoid proportional valve 221.

Modification of Operation Speed Limitation Command Calculation Method

In the above embodiment, the explanation has been given of an example in which the operation limitation determination unit 60*h* calculates the operation speed limitation gain and the command value generation unit 60*i* calculates the drive command value for the speed limitation solenoid proportional valve 251 by using the operation speed limitation gain and the lever operation pilot pressure. With such features, the operation speed limitation can be performed appropriately even when the relationship between the pilot pressure and the operation speed changes depending on the working conditions.

In contrast, in cases where the operation speed is uniquely determined by the pilot pressure irrespective of the working conditions, the following configuration may be employed: The operation limitation determination unit 60*h* calculates an upper limit value of the operation speed instead of the operation speed limitation gain. The command value generation unit 60*i* calculates a pilot pressure upper limit value from the operation speed upper limit value by using a relational equation between the pilot pressure and the operation speed, and issues the drive command by specifying the pilot pressure upper limit value as the command pressure of the speed limitation solenoid proportional valve 251.

Second Embodiment

Figure 10:
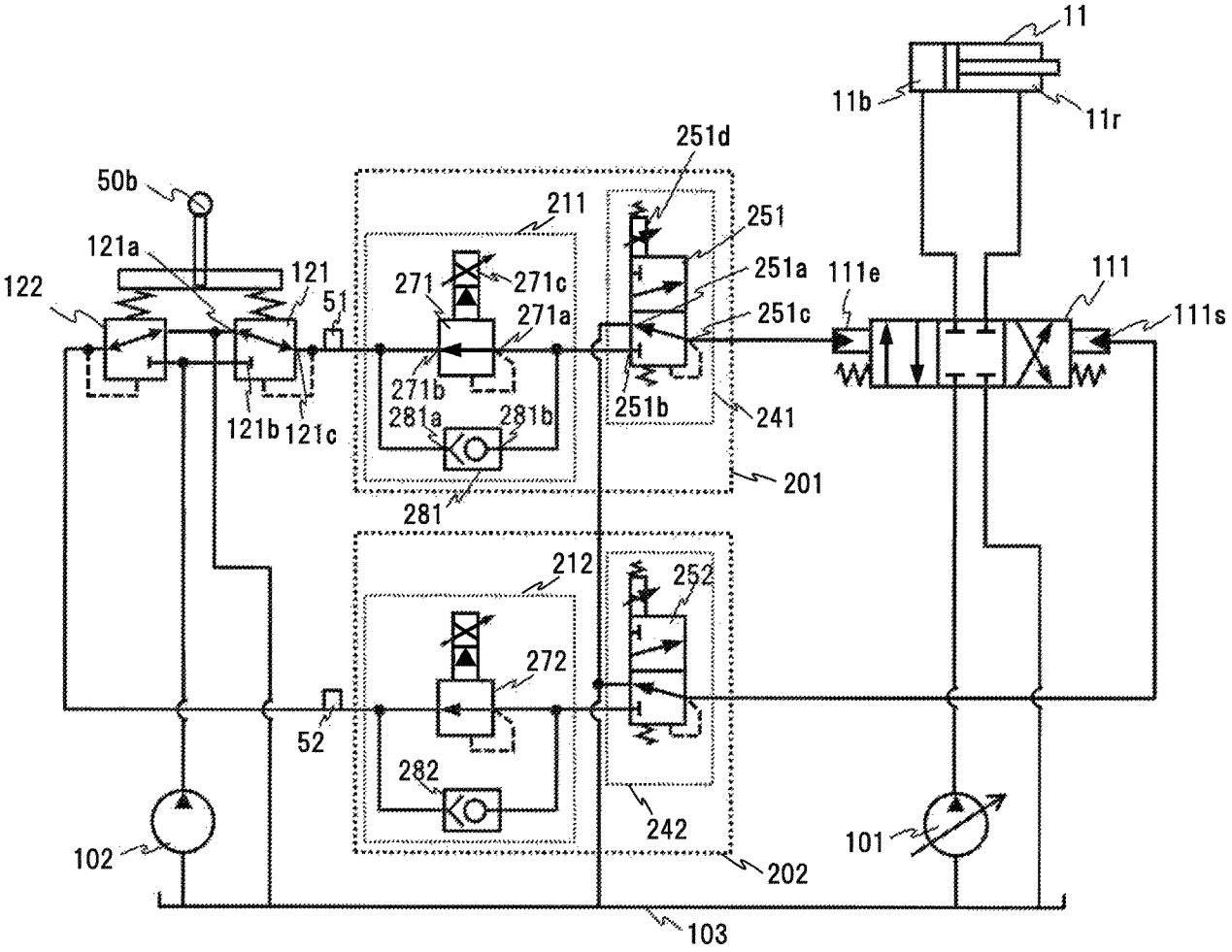
FIG. 10 is a schematic configuration diagram of a pilot pressure correction unit according to a second embodiment.

A second embodiment of the work machine according to the present invention will be described below with reference to FIG. 10.

In this embodiment, a solenoid proportional pressure holding valve set including gradual stoppage solenoid proportional pressure holding valves 271 and 272 and a check valve set including gradual stoppage check valves 281 and 282 are employed as the stoppage characteristic modification unit 210 instead of the gradual stoppage solenoid proportional valve set including the gradual stoppage solenoid proportional valves 221 and 222 and the gradual stoppage high pressure selection unit set including the gradual stoppage high pressure selection units 231 and 232 employed in the first embodiment. In the following, the difference from the first embodiment will be mainly explained by referring to FIG. 10. Components in this embodiment identical with those in FIGS. 1-9B are assigned the already used reference characters and repeated explanation thereof is omitted for brevity. The same goes for the subsequent embodiment.

Pilot Pressure Correction Unit

The pilot pressure correction unit 200 in this embodiment includes a stoppage characteristic modification unit 210 and an operation speed limitation unit 240 similarly to the first embodiment. To apply the operation limitation based on the stabilization control calculation to the boom cylinder 11 and the arm cylinder 13, the work machine 1 is equipped with a boom expansion pilot pressure correction unit 201, a boom contraction pilot pressure correction unit 202, an arm expansion pilot pressure correction unit (unshown) and an arm contraction pilot pressure correction unit (unshown) as a pilot pressure correction unit 200. The pilot pressure correction units 201 and 202 are configured equivalently to each other. Specifically, the boom expansion pilot pressure correction unit 201 includes a boom expansion stoppage characteristic modification unit 211 and a boom expansion operation speed limitation unit 241, and the boom contraction pilot pressure correction unit 202 includes a boom contraction stoppage characteristic modification unit 212 and a boom contraction operation speed limitation unit 242. Similarly, the unshown arm expansion pilot pressure correction unit includes an arm expansion stoppage characteristic modification unit and an arm expansion operation speed limitation unit, and the unshown arm contraction pilot pressure correction unit includes an arm contraction stoppage characteristic modification unit and an arm contraction operation speed limitation unit. The configuration of each operation speed limitation unit 241, 242, . . . in this embodiment is equivalent to that in the first embodiment. The following explanation will be given of the boom expansion stoppage characteristic modification unit 211 only, by taking the correction of the boom expansion pilot hydraulic fluid as an example.

Stoppage Characteristic Modification Unit

The boom expansion stoppage characteristic modification unit 211 in this embodiment includes the gradual stoppage solenoid proportional pressure holding valve 271 as a component of the solenoid proportional pressure holding valve set and the gradual stoppage check valve 281 as a component of the check valve set.

The gradual stoppage check valve 281 is a valve for limiting the flow direction of the hydraulic fluid. The gradual stoppage solenoid proportional pressure holding valve 271 is a valve for controlling the discharge of the pilot hydraulic fluid to the hydraulic fluid tank 103. The gradual stoppage check valve 281 and the gradual stoppage solenoid proportional pressure holding valve 271 are arranged in parallel in a hydraulic line connecting the proportional pressure reducing valve 121 and the operation speed limitation unit 241. Specifically, a pilot hydraulic line having the gradual stoppage check valve 281 and a pilot hydraulic line having the gradual stoppage solenoid proportional pressure holding valve 271 are provided between the proportional pressure reducing valve 121 and the operation speed limitation unit 241, and the hydraulic fluid flows through either of the hydraulic lines. The details of the gradual stoppage check valve 281 and the gradual stoppage solenoid proportional pressure holding valve 271 will be explained below.

The gradual stoppage check valve 281, as a valve for limiting the flow direction of the hydraulic fluid, has an input port 281*a* and an output port 281*b*. The input port 281*a* is connected with the third port 121*c* of the proportional pressure reducing valve 121, while the output port 281*b* is connected with the second port 251*b* of the speed limitation solenoid proportional valve 251 constituting the operation speed limitation unit 241. The flow of the hydraulic fluid from the proportional pressure reducing valve 121 to the operation speed limitation unit 241 is allowed as a free flow, while the flow of the hydraulic fluid from the operation speed limitation unit 241 to the proportional pressure reducing valve 121 is interrupted. Therefore, the hydraulic fluid flows through the pilot hydraulic line having the gradual stoppage check valve 281 when flowing from the proportional pressure reducing valve 121 to the operation speed limitation unit 241, and flows through the pilot hydraulic line having the gradual stoppage solenoid proportional pressure holding valve 271 when flowing from the operation speed limitation unit 241 to the proportional pressure reducing valve 121.

As mentioned above, the direction of the flow of the hydraulic fluid in the pilot hydraulic line is determined by the status of the operation on the control lever 50. When the control lever 50 is operated in a direction for increasing the lever operation pilot pressure outputted from the proportional pressure reducing valve 121, the pilot hydraulic fluid is supplied from the proportional pressure reducing valve 121 to the pilot hydraulic line. When the control lever 50 is operated in a direction for decreasing the lever operation pilot pressure, the hydraulic fluid in the pilot hydraulic line is discharged to the hydraulic fluid tank 103 through the valve passage for the communication between the first port 121*a* and the third port 121*c* of the proportional pressure reducing valve 121. Therefore, the stoppage characteristic modification unit 211 in this embodiment has a configuration for allowing the free flow in the supply of the hydraulic fluid at times of increasing the lever operation pilot pressure, while controlling the flow of the hydraulic fluid at times of decreasing the lever operation pilot pressure, that is, at times of decelerating the drive actuator, by using the gradual stoppage solenoid proportional pressure holding valve 271.

The gradual stoppage solenoid proportional pressure holding valve 271 has a first port 271*a*, a second port 271*b*, and a solenoid 271*c*. The first port 271*a* is connected to the second port 251*b* of the speed limitation solenoid proportional valve 251, while the second port 271*b* is connected to the third port 121*c* of the proportional pressure reducing valve 121. The solenoid 271*c* is excited by a command signal from a calculation device 60. The hold pressure of the gradual stoppage solenoid proportional pressure holding valve 271 is determined by the magnitude of the command signal.

In the gradual stoppage solenoid proportional pressure holding valve 271, when the pressure on the first port 271*a* side is higher than the hold pressure, a valve passage for the communication between the first port 271*a* and the second port 271*b* opens and the hydraulic fluid is supplied from the first port 271*a* to the second port 271*b*. As mentioned above, the hydraulic fluid flows through the gradual stoppage solenoid proportional pressure holding valve 271 only when it flows from the operation speed limitation unit 241 to the proportional pressure reducing valve 121. In this case, the hydraulic fluid supplied to the proportional pressure reducing valve 121 is discharged to the hydraulic fluid tank 103 through the valve passage for the communication between the first port 121*a* and the third port 121*c* of the proportional pressure reducing valve 121. To sum up, the gradual stoppage solenoid proportional pressure holding valve 271 discharges the hydraulic fluid to the hydraulic fluid tank 103 when the pressure of the hydraulic fluid in the pilot hydraulic line connecting the gradual stoppage solenoid proportional pressure holding valve 271 and the operation speed limitation unit 241 is higher than the hold pressure, while interrupting the discharge of the hydraulic fluid to the hydraulic fluid tank 103 when the pressure is lower than the hold pressure. By this operation, the pressure of the pilot hydraulic fluid is held at the hold pressure.

When the solenoid 271*c* is not excited, the valve passage for the communication between the first port 271*a* and the second port 271*b* fully opens irrespective of the pressure of the hydraulic fluid in the pilot hydraulic line, and the discharge of the hydraulic fluid to the hydraulic fluid tank 103 is conducted freely.

In contrast, when the maximum drive command is issued to the gradual stoppage solenoid proportional pressure holding valve 271, the valve passage for the communication between the first port 271*a* and the second port 271*b* is set in the closed state and the hydraulic fluid in the pilot hydraulic line is not discharged to the hydraulic fluid tank 103 even if the control lever 50 is operated to decelerate or stop the drive actuator. In this case, the pressure of the pilot hydraulic fluid supplied to the operation speed limitation unit 241 is kept at the maximum pressure of the lever operation pilot pressure outputted from the proportional pressure reducing valve 121 according to the lever operation and the drive actuator continues operating without being decelerated.

As above, by gradually decreasing the hold pressure of the gradual stoppage solenoid proportional pressure holding valve 271, the pressure of the pilot hydraulic fluid can be decreased gradually and the drive actuator can be decelerated gradually. Thus, by setting the hold pressure of the gradual stoppage solenoid proportional pressure holding valve 271 at pressures satisfying the stoppage characteristic of the gradual stoppage commanded by a stabilization control calculation unit 60*a*, the commanded gradual stoppage can be carried out similarly to the case of employing the gradual stoppage solenoid proportional valve 221.

Calculation Device

Similarly to the first embodiment, the calculation device 60 includes an input unit 60*x* to which signals from sensors attached to various parts of the work machine 1 are inputted, a calculation unit 60*z* that receives the signals inputted to the input unit 60*x* and performs prescribed calculations, and an output unit 60*y* that receives output signals from the calculation unit 60*z* and outputs drive commands to the pilot pressure correction unit 200. The calculation unit 60*z* includes the stabilization control calculation unit 60*a* for calculating the operation limitation necessary for keeping the work machine 1 stable and a command value generation unit 60*i* for calculating the drive commands for the pilot pressure correction unit 200.

The calculation device 60 in this embodiment differs from that in the first embodiment only in the method for calculating the drive commands for the stoppage characteristic modification unit 210 employed by the command value generation unit 60*i*. The following explanation will be given only of the method for calculating the drive command for the gradual stoppage solenoid proportional pressure holding valve 271 employed by the command value generation unit 60*i*, by taking the correction of the boom expansion pilot hydraulic fluid as an example.

Command Value Generation Unit

The boom expansion stoppage characteristic modification unit 211 in this embodiment includes the gradual stoppage check valve 281 and the gradual stoppage solenoid proportional pressure holding valve 271. The drive actuator is stopped gradually by driving the gradual stoppage solenoid proportional pressure holding valve 271 so that the pressure of the pilot hydraulic fluid outputted from the stoppage characteristic modification unit 211 satisfies the gradual stoppage command outputted from the operation limitation determination unit 60*h*.

Similarly to the first embodiment, the following explanation of the method for calculating the drive command value for the gradual stoppage solenoid proportional pressure holding valve 271 will be given by taking an example of a case where the rate of change of the pressure of the pilot hydraulic fluid supplied to the boom flow control valve 111 is commanded as the stoppage characteristic and the lever operation pilot pressure is corrected by using the correction curve shown in FIG. 4A.

To perform the commanded gradual stoppage in this embodiment, the output pressure of the stoppage characteristic modification unit 211 has to be set at the pressure calculated according to the equation (7). Driving the gradual stoppage solenoid proportional pressure holding valve 271 is unnecessary when the hydraulic fluid does not flow through the gradual stoppage solenoid proportional pressure holding valve 271 or the correction of the output pressure by the gradual stoppage solenoid proportional pressure holding valve 271 is unnecessary. In other words, it is sufficient if the gradual stoppage solenoid proportional pressure holding valve 271 is driven to set the hold pressure at the pressure calculated according to the equation (7) only when the rate of change of the lever operation pilot pressure is higher than the change rate command value. Thus, the hold pressure of the gradual stoppage solenoid proportional pressure holding valve 271 may be set at the pressure calculated according to the equation (8) similarly to the command pressure of the gradual stoppage solenoid proportional valve 221 in the first embodiment. The hold pressure of the gradual stoppage solenoid proportional pressure holding valve 271 is determined by the magnitude of the command signal given to the solenoid 271*c*, and the relationship between the command signal and the pressure is previously given as the output characteristic of the valve. Therefore, the drive command value for the gradual stoppage solenoid proportional pressure holding valve 271 is calculated by using the hold pressure calculated according to the equation (8) and the output characteristic of the valve.

Characteristics

By employing the stoppage characteristic modification unit 211 configured as in this embodiment, at times of operations not dropping the lever operation pilot pressure, that is, at times of steady motion command operation, acceleration operation, etc., the lever operation pilot hydraulic fluid flows through the hydraulic line having the gradual stoppage check valve 281 and is outputted without being corrected. The correction by the gradual stoppage solenoid proportional pressure holding valve 271 is not made also when the operator's operation is performed in such a manner as to cause a more gradual stoppage than the stoppage characteristic of the gradual stoppage commanded by the stabilization control calculation unit 60*a*.

In contrast, when the lever operation pilot pressure drops more sharply than the stoppage characteristic of the gradual stoppage commanded by the stabilization control calculation unit 60*a*, the gradual stoppage solenoid proportional pressure holding valve 271 is driven so that the output pressure of the stoppage characteristic modification unit 211 satisfies the commanded stoppage characteristic of the gradual stoppage, the discharge of the pilot hydraulic fluid to the hydraulic fluid tank 103 is controlled by the gradual stoppage solenoid proportional pressure holding valve 271, and the gradual stoppage with the commanded stoppage characteristic is realized.

Therefore, the stoppage characteristic modification unit 211 in this embodiment, having a configuration to make the correction only when the pressure of the lever operation pilot hydraulic fluid does not satisfy the gradual stoppage command from the stabilization control calculation unit 60*a* similarly to the stoppage characteristic modification unit 211 in the first embodiment, is capable of performing the operation limitation without affecting the conventional operability.

Further, in the stoppage characteristic modification unit 211 in this embodiment, the gradual stoppage check valve 281 allows the free flow of the pilot hydraulic fluid from the proportional pressure reducing valve 121 to the boom flow control valve 111, and thus the gradual stoppage solenoid proportional pressure holding valve 271 has no influence on the flow of the hydraulic fluid in the direction for driving the drive actuator irrespective of the status of the driving of the solenoid 271*c*.

Furthermore, while the stoppage characteristic modification unit 211 in the first embodiment generates the gradual stoppage pilot pressure by use of the hydraulic fluid delivered from the pilot pump 102, the stoppage characteristic modification unit 211 in the second embodiment implements the gradual stoppage by making the drop in the pilot pressure gradual through the control of the discharge of the pilot hydraulic fluid to the hydraulic fluid tank 103. Thus, the second embodiment implements the gradual stoppage without the need of newly introducing the hydraulic fluid into the pilot hydraulic line, with an advantage in that even when an erroneous command signal is given to the gradual stoppage solenoid proportional pressure holding valve 271, there is no danger of the drive actuator operating in spite of the control lever in the non-operation state, that is, high safety is achieved.

Third Embodiment

Figure 11:
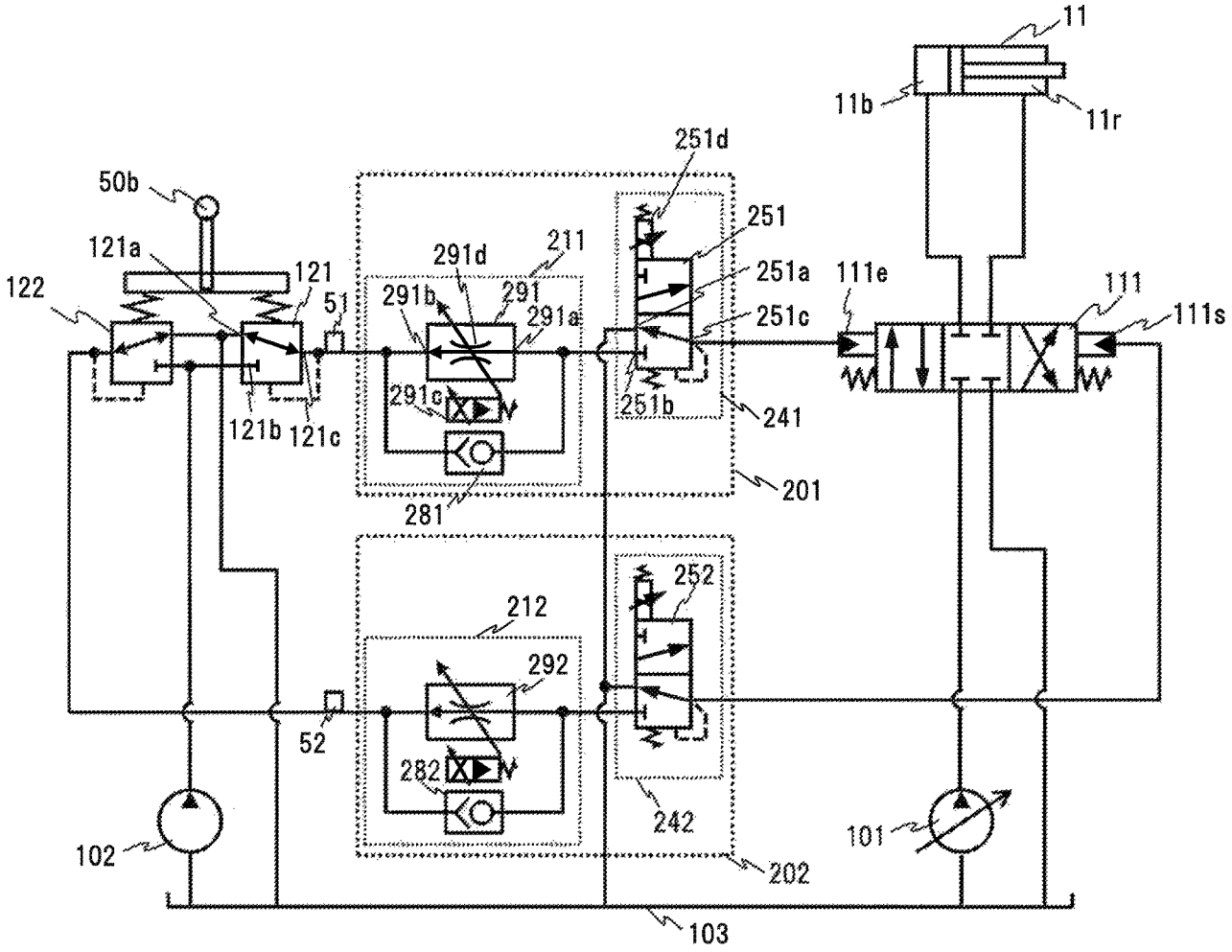
FIG. 11 is a schematic configuration diagram of a pilot pressure correction unit according to a third embodiment.

A third embodiment of the work machine according to the present invention will be described below with reference to FIG. 11.

In the above second embodiment, the check valve set including the gradual stoppage check valves 281 and 282 and the solenoid proportional pressure holding valve set including the gradual stoppage solenoid proportional pressure holding valves 271 and 272 were employed as the stoppage characteristic modification unit 210. In this embodiment, a solenoid proportional flow control valve set including gradual stoppage solenoid proportional flow control valves 291 and 292 is employed instead of the solenoid proportional pressure holding valve set including the gradual stoppage solenoid proportional pressure holding valves 271 and 272. In the following, the difference from the first and second embodiments will be mainly explained by referring to FIG. 11.

Pilot Pressure Correction Unit

Similarly to the first and second embodiments, a pilot pressure correction unit 200 in this embodiment includes a stoppage characteristic modification unit 210 and an operation speed limitation unit 240. The work machine 1 is equipped with a boom expansion pilot pressure correction unit 201, a boom contraction pilot pressure correction unit 202, an arm expansion pilot pressure correction unit (unshown) and an arm contraction pilot pressure correction unit (unshown) as the pilot pressure correction unit 200. The pilot pressure correction units 201 and 202 are configured equivalently to each other. Specifically, the boom expansion pilot pressure correction unit 201 includes a boom expansion stoppage characteristic modification unit 211 and a boom expansion operation speed limitation unit 241, and the boom contraction pilot pressure correction unit 202 includes a boom contraction stoppage characteristic modification unit 212 and a boom contraction operation speed limitation unit 242. The unshown arm expansion pilot pressure correction unit includes an arm expansion stoppage characteristic modification unit and an arm expansion operation speed limitation unit, and the unshown arm contraction pilot pressure correction unit includes an arm contraction stoppage characteristic modification unit and an arm contraction operation speed limitation unit. Each operation speed limitation unit 241, 242, . . . in this embodiment is equivalent to that in the first embodiment. The following explanation will be given of the boom expansion stoppage characteristic modification unit 211 only, by taking the correction of the boom expansion pilot hydraulic fluid as an example.

Stoppage Characteristic Modification Unit

The boom expansion stoppage characteristic modification unit 211 in this embodiment includes a gradual stoppage check valve 281 and a gradual stoppage solenoid proportional flow control valve 291. The gradual stoppage check valve 281 is a valve for limiting the flow direction of the hydraulic fluid. The gradual stoppage solenoid proportional flow control valve 291 is a valve for controlling the discharge of the hydraulic fluid from the pilot hydraulic line to the hydraulic fluid tank 103.

The gradual stoppage solenoid proportional flow control valve 291 is the valve provided instead of the gradual stoppage solenoid proportional pressure holding valve 271 in the second embodiment. The gradual stoppage check valve 281 and the gradual stoppage solenoid proportional flow control valve 291 are arranged in parallel in the hydraulic line connecting the proportional pressure reducing valve 121 and the operation speed limitation unit 241.

The configuration and function of the gradual stoppage check valve 281 are equivalent to those in the second embodiment. The stoppage characteristic modification unit 211 in this embodiment has a configuration for allowing the free flow in the supply of the hydraulic fluid at times of increasing the lever operation pilot pressure, while controlling the flow of the hydraulic fluid at times of decreasing the lever operation pilot pressure, that is, at times of decelerating the drive actuator, by using the gradual stoppage solenoid proportional flow control valve 291. The details of the gradual stoppage solenoid proportional flow control valve 291 will be explained below.

The gradual stoppage solenoid proportional flow control valve 291 has a first port 291*a*, a second port 291*b*, and a solenoid 291*c*. The first port 291*a* is connected to the second port 251*b* of the speed limitation solenoid proportional valve 251, while the second port 291*b* is connected to the third port 121*c* of the proportional pressure reducing valve 121. A valve passage for the communication between the first port 291*a* and the second port 291*b* is equipped with a restrictor 291*d* whose opening degree is variable. The solenoid 291*c* is excited by a command signal from the calculation device 60. The opening degree of the restrictor 291*d* is determined by the magnitude of the command signal.

As mentioned above, the hydraulic fluid flows through the gradual stoppage solenoid proportional flow control valve 291 only when it flows from the operation speed limitation unit 241 to the proportional pressure reducing valve 121. The gradual stoppage solenoid proportional flow control valve 291 has a function of controlling the discharge of the pilot hydraulic fluid to the hydraulic fluid tank 103 when the operator has performed an operation for decelerating the drive actuator. The flow rate of the hydraulic fluid through the valve passage for the communication between the first port 291*a* and the second port 291*b* is determined by the opening degree of the restrictor 291*d*.

Specifically, when the opening degree of the restrictor 291*d* is high, the flow rate of the hydraulic fluid that can flow through the valve passage is high and the pilot hydraulic fluid is quickly discharged to the hydraulic fluid tank 103. Accordingly, the pressure of the pilot hydraulic fluid drops quickly. When the opening degree of the restrictor 291*d* is set at the maximum, the flow of the hydraulic fluid through the valve passage becomes the free flow. In contrast, when the opening degree of the restrictor 291*d* is reduced, the flow rate of the hydraulic fluid flowing from the first port 291*a* to the second port 291*b* is limited and the discharge of the pilot hydraulic fluid to the hydraulic fluid tank 103 becomes gradual. Accordingly, the pressure of the pilot hydraulic fluid drops gradually. Therefore, the gradual stoppage with the commanded stoppage characteristic can be carried out by appropriately regulating the opening degree of the restrictor 291*d* of the gradual stoppage solenoid proportional flow control valve 291.

Calculation Device

Similarly to the first and second embodiments, the calculation device 60 includes a input unit 60*x* to which signals from sensors attached to various parts of the work machine 1 are inputted, a calculation unit 60*z* that receives the signals inputted to the input unit 60*x* and performs prescribed calculations, and an output unit 60*y* that receives output signals from the calculation unit 60*z* and outputs drive commands to the pilot pressure correction unit 200. The calculation unit 60*z* includes a stabilization control calculation unit 60*a* for calculating the operation limitation necessary for keeping the work machine 1 stable and a command value generation unit 60*i* for calculating the drive commands for the pilot pressure correction unit 200.

The calculation device 60 in this embodiment differs from those in the first and second embodiments only in the method for calculating the drive commands for the stoppage characteristic modification unit 210 employed by the command value generation unit 60*i*. The following explanation will be given only of the method for calculating the drive command for the gradual stoppage solenoid proportional flow control valve 291 employed by the command value generation unit 60*i*, by taking the correction of the boom expansion pilot hydraulic fluid as an example.

Command Value Generation Unit

The boom expansion stoppage characteristic modification unit 211 in this embodiment includes the gradual stoppage check valve 281 and the gradual stoppage solenoid proportional flow control valve 291. The stoppage characteristic of the drive actuator is modified to a desired characteristic by appropriately regulating the opening degree of the restrictor 291*d* arranged inside the gradual stoppage solenoid proportional flow control valve 291.

As mentioned above, when the operator has performed an operation for decelerating the drive actuator, the pressure of the pilot hydraulic fluid supplied to the operation speed limitation unit 241 drops more sharply as the opening degree of the restrictor 291*d* is increased, and more gradually as the opening degree is decreased. The relationship between the stoppage characteristic and the opening degree of the restrictor 291*d* is previously given as a flow rate characteristic of the valve. When the opening degree of the restrictor 291*d* is set at the maximum, the flow of the hydraulic fluid through the valve passage becomes the free flow. Therefore, the opening degree of the restrictor 291*d* is set at the maximum when the correction of the lever operation pilot pressure in the stoppage characteristic modification unit 211 is unnecessary.

In contrast, when the lever operation pilot pressure does not satisfy the gradual stoppage command outputted from the stabilization control calculation unit 60*a*, the opening degree of the restrictor 291*d* is determined by using the commanded stoppage characteristic of the gradual stoppage and the flow rate characteristic of the valve. The opening degree of the restrictor 291*d* of the gradual stoppage solenoid proportional flow control valve 291 is determined by the magnitude of the command signal given to the solenoid 291*c*. The relationship between the command signal and the opening degree is also previously given as a characteristic of the valve. Therefore, the drive command value for the gradual stoppage solenoid proportional flow control valve 291 is calculated by using the opening degree of the restrictor 291*d* determined as above and the output characteristic of the valve.

Characteristics

By employing the stoppage characteristic modification unit 211 in this embodiment, at times of operations not dropping the lever operation pilot pressure, that is, at times of steady motion command operation, acceleration operation, etc., the lever operation pilot hydraulic fluid flows through the hydraulic line having the gradual stoppage check valve 281 and is outputted without being corrected. When the operator's operation is performed in such a manner as to cause a more gradual stoppage than the stoppage characteristic of the gradual stoppage commanded by the stabilization control calculation unit 60*a*, the lever operation pilot hydraulic fluid is not influenced by the flow rate limitation by the restrictor 291*d* of the gradual stoppage solenoid proportional flow control valve 291 and is not corrected.

In contrast, when the lever operation pilot pressure drops more sharply than the stoppage characteristic of the gradual stoppage commanded by the stabilization control calculation unit 60*a*, the discharge of the pilot hydraulic fluid to the hydraulic fluid tank 103 is controlled by the restrictor 291*d* of the gradual stoppage solenoid proportional flow control valve 291 and the gradual stoppage with the commanded stoppage characteristic is realized.

Therefore, the stoppage characteristic modification unit 211 in this embodiment, having a configuration to make the correction only when the pressure of the lever operation pilot hydraulic fluid does not satisfy the gradual stoppage command from the stabilization control calculation unit 60*a* similarly to the stoppage characteristic modification units 211 in the first and second embodiments, is capable of performing the operation limitation without affecting the conventional operability.

Further, in the stoppage characteristic modification unit 211 in this embodiment, the gradual stoppage check valve 281 allows the free flow of the pilot hydraulic fluid from the proportional pressure reducing valve 121 to the boom flow control valve 111, and thus the gradual stoppage solenoid proportional flow control valve 291 has no influence on the flow of the hydraulic fluid in the direction for driving the drive actuator irrespective of the status of the driving of the solenoid 291*c*. Furthermore, since the gradual stoppage in this embodiment is implemented by making the drop in the pilot pressure gradual through the control of the discharge of the pilot hydraulic fluid to the hydraulic fluid tank 103 similarly to the second embodiment, it is unnecessary to newly introduce the hydraulic fluid into the pilot hydraulic line from the pilot pump in order to perform the gradual stoppage. Therefore, this embodiment has an advantage in that even when an erroneous command signal is given to the gradual stoppage solenoid proportional flow control valve 291, there is no danger of the drive actuator operating in spite of the control lever in the non-operation state, that is, high safety is achieved.

Moreover, in the case of employing the gradual stoppage solenoid proportional flow control valve 291, the amount determined by the command signal from the calculation unit 60*z* is the opening degree of the restrictor 291*d* of the gradual stoppage solenoid proportional flow control valve 291, that is, the flow rate of the pilot hydraulic fluid, which is not the pressure of the pilot hydraulic fluid supplied to the boom flow control valve 111. Therefore, it is impossible to precisely control the pressure of the pilot hydraulic fluid supplied to the boom flow control valve 111. On the other hand, the calculation of the command signal by the command value generation unit 60*i* of the calculation device 60 becomes simple. In the aforementioned case where the pressure outputted from the stoppage characteristic modification unit 211 is determined by a command signal outputted from the calculation device 60, the command signal has to be changed from moment to moment in the stoppage process. In contrast, in the case of employing the gradual stoppage solenoid proportional flow control valve 291, it is enough if the opening degree of the restrictor 291*d* is determined according to the commanded stoppage characteristic, the judgment on whether a sudden stoppage operation is in progress or not is unnecessary, and the changing of the command signal in the stoppage process is unnecessary. Therefore, this embodiment has an advantage in that the calculation process for calculating the command signal is simplified.

Other Examples

Incidentally, the present invention is not to be restricted to the above-described embodiments but includes a variety of modifications. The embodiments, which have been described in detail for the purpose of an easily understandable description of the present invention, are not necessarily restricted to those including all the components described above. It is possible to replace part of the configuration of an embodiment with a configuration in another embodiment or to add a configuration in an embodiment to a configuration in another embodiment. It is also possible to make an addition/deletion/replacement of a configuration in regard to part of the configuration of each embodiment.

For example, the stability discrimination method is not restricted to the mode using the ZMP only; the discrimination can also be made by using two evaluation indices: the ZMP and mechanical energy.

Further, examples of the correction of the pilot pressure for performing the gradual stoppage are not restricted to the mode of correcting the pilot pressure so that the pilot pressure monotonically decreases satisfying the change rate command value as shown in FIG. 4A; a correction with a certain change in the decrease ratio of the pilot pressure is also possible.

What is claimed is:

1. A work machine comprising:

a track structure;

a swing structure mounted on top of the track structure to be swingable;

a front work implement attached to the swing structure to be freely pivotable in a vertical direction with respect to the swing structure and including a plurality of movable parts;

a drive actuator that drives the swing structure and a corresponding movable part of the front work implement;

a main pump for supplying hydraulic fluid for driving the drive actuator;

a CPU for calculating a drive command for driving the drive actuator;

a flow control valve for controlling an amount of hydraulic fluid supplied from the main pump to the drive actuator;

a proportional pressure reducing valve for controlling pilot hydraulic fluid for controlling the flow control valve based on an operation on a control lever;

an attitude detection unit for detecting an attitude of the work machine, the CPU configured to estimate a speed of the drive actuator, predict a behavior at the time of a sudden stop operation of the work machine based on the estimated speed and a detection result of the attitude detection unit, judge stability of the work machine based on the predicted behavior of the work machine, and calculate and output a gradual stoppage command for limiting deceleration of the drive actuator and making the drive actuator stop gradually, and an operation speed limitation command for limiting upper limit operation speed of the drive actuator based on judgment result;

a stoppage characteristic modification unit including a check valve and a solenoid proportional hydraulic fluid discharge control valve, configured for correcting pilot hydraulic fluid outputted from the proportional pressure reducing valve so as to limit the deceleration of the drive actuator and gradually stop the drive actuator based on the gradual stoppage command; and an operation speed limitation unit for correcting the pressure of the pilot hydraulic fluid outputted from the proportional pressure reducing valve so as to limit the speed of the drive actuator based on the operation speed limitation command, wherein the check valve and the solenoid proportional hydraulic fluid discharge control valve are arranged in parallel in a pilot hydraulic line connecting the proportional pressure reducing valve and the flow control valve, the check valve allows a flow of the hydraulic fluid from the proportional pressure reducing valve to the flow control valve as a free flow while interrupting the flow of the hydraulic fluid from the flow control valve to the proportional pressure reducing valve, and the solenoid proportional hydraulic fluid discharge control valve controls the flow of the hydraulic fluid from the flow control valve to the proportional pressure reducing valve according to a command signal from the calculation device.

2. The work machine according to claim 1, wherein the solenoid proportional hydraulic fluid discharge control valve includes a solenoid proportional pressure holding valve that interrupts the flow of the hydraulic fluid when pilot pressure supplied to the flow control valve is lower than a hold pressure that is set by a command signal from the calculation device and allows the flow of the hydraulic fluid when the pilot pressure is higher than the hold pressure.

3. The work machine according to claim 1, wherein:

the solenoid proportional hydraulic fluid discharge control valve includes a solenoid proportional flow control valve having a restrictor whose opening degree is variable by a command signal from the calculation device, and the calculation device determines the opening degree of the restrictor of the solenoid proportional flow control valve based on the gradual stoppage command outputted from the operation limitation determination unit.

* * * * *